US009404342B2

(12) United States Patent
Harrington et al.

(10) Patent No.: US 9,404,342 B2
(45) **Date of Patent: *Aug. 2, 2016**

(54) TOP MOUNTED CHOKE FOR PERCUSSION TOOL

(71) Applicant: Varel International Ind., L.P., Carrollton, TX (US)

(72) Inventors: David Harrington, Dallas, TX (US); Anthony Plana, Prosper, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 288 days.

This patent is subject to a terminal disclaimer.

(21) Appl. No.: 14/079,342

(22) Filed: Nov. 13, 2013

(65) Prior Publication Data

US 2015/0129316 A1 May 14, 2015

(51) Int. Cl.
*E21B 34/10* (2006.01)
*E21B 4/14* (2006.01)

(52) U.S. Cl.
CPC . *E21B 34/10* (2013.01); *E21B 4/14* (2013.01); *Y10T 29/49229* (2015.01)

(58) Field of Classification Search
CPC ..... E21B 1/00; E21B 1/02; E21B 6/00; E21B 6/02; E21B 34/10
See application file for complete search history.

(56) References Cited

U.S. PATENT DOCUMENTS

| | | | |
|---|---|---|---|
| 1,871,319 | A | 8/1932 | Griswold et al. |
| 2,353,652 | A | 7/1944 | Coonrod |
| 2,494,803 | A | 1/1950 | Frost et al. |
| 3,065,807 | A | 11/1962 | Wells |
| 3,101,796 | A | 8/1963 | Stall et al. |
| 3,265,091 | A | 8/1966 | De Jarnett |
| 3,353,607 | A | 11/1967 | Kinley |
| 3,379,261 | A | 4/1968 | Martini |
| 3,471,177 | A | 10/1969 | Garrett et al. |
| 3,586,104 | A | 6/1971 | Hyde |
| 3,638,970 | A | 2/1972 | Sandquist et al. |
| 3,664,441 | A | 5/1972 | Carey |
| 3,747,698 | A | 7/1973 | Chapman |

(Continued)

FOREIGN PATENT DOCUMENTS

| | | |
|---|---|---|
| WO | 9532355 | 11/1995 |
| WO | 9832945 | 7/1998 |

(Continued)

OTHER PUBLICATIONS

Thomas, Shane, International Search Report and Written Opinion of the International Searching Authority for PCT/US2015/014883, Apr. 15, 2015, pp. 1-8.
Thomas, Shane, International Search Report and Written Opinion of the International Searching Authority for PCT/US2015/065435, Jan. 21, 2015, pp. 1-10.

(Continued)

*Primary Examiner* — William P Neuder

(57) ABSTRACT

A system and method of fabricating a percussion tool that includes a choke valve that is replaceable and/or maintainable without disassembly of the percussion tool. The flow tube includes inner and outer walls and at least one opening formed in the outer wall. The inner wall extends from a top end of the flow tube to a bottom end of the flow tube and defines a central channel therein. The outer wall extends from the top end towards the bottom end, surrounds a portion of the inner wall, and defines an outer channel with the inner wall. The choke is positioned at the top end over the central channel and regulate a fluid flow therethrough. A check valve is positioned in fluid communication with the choke.

38 Claims, 14 Drawing Sheets

(56) References Cited

U.S. PATENT DOCUMENTS

| | | | | |
|---|---|---|---|---|
| 3,786,878 | A | 1/1974 | Chapman | |
| 3,795,283 | A | 3/1974 | Oughton | |
| 3,860,272 | A | 1/1975 | Becker | |
| 3,928,903 | A | 12/1975 | Richardson et al. | |
| 3,964,551 | A | 6/1976 | Bassinger | |
| 3,970,335 | A | 7/1976 | Curington et al. | |
| 3,998,479 | A | 12/1976 | Bishop | |
| 4,012,061 | A | 3/1977 | Olson | |
| 4,067,596 | A | 1/1978 | Kellner et al. | |
| 4,070,043 | A | 1/1978 | Becker | |
| 4,106,571 | A | 8/1978 | Stone | |
| 4,149,739 | A | 4/1979 | Morris | |
| 4,185,704 | A | 1/1980 | Nixon, Jr. | |
| 4,190,073 | A | 2/1980 | Claycomb | |
| 4,257,442 | A | 3/1981 | Claycomb | |
| 4,280,535 | A | 7/1981 | Willis | |
| 4,280,570 | A | 7/1981 | Walter | |
| 4,281,678 | A | 8/1981 | Claycomb | |
| 4,282,942 | A | 8/1981 | Longmore | |
| 4,337,563 | A | 7/1982 | Becker et al. | |
| 4,337,788 | A | 7/1982 | Seger | |
| 4,385,668 | A | 5/1983 | Becker et al. | |
| 4,444,220 | A | 4/1984 | Seger | |
| 4,470,430 | A | 9/1984 | Lancaster | |
| 4,534,422 | A * | 8/1985 | Rear | E21B 4/14 173/13 |
| 4,565,394 | A | 1/1986 | Becker | |
| 4,618,172 | A | 10/1986 | Becker | |
| 4,644,974 | A | 2/1987 | Zingg | |
| 4,662,401 | A | 5/1987 | Zingg et al. | |
| 4,665,996 | A | 5/1987 | Foroulis et al. | |
| 4,705,118 | A | 11/1987 | Ennis | |
| 4,784,223 | A | 11/1988 | Worrall et al. | |
| 4,819,746 | A | 4/1989 | Brown et al. | |
| 4,872,507 | A | 10/1989 | Ronco, Sr. et al. | |
| 4,913,466 | A | 4/1990 | Becker | |
| 4,951,409 | A | 8/1990 | Froid | |
| 5,029,646 | A | 7/1991 | Blizzard, Jr. | |
| 5,095,994 | A | 3/1992 | Dollison | |
| 5,186,266 | A | 2/1993 | Heller | |
| 5,190,106 | A | 3/1993 | Johnston | |
| 5,217,046 | A | 6/1993 | Woods | |
| 5,246,074 | A | 9/1993 | Ayres | |
| 5,253,708 | A | 10/1993 | Alexander | |
| 5,365,978 | A | 11/1994 | Woods | |
| 5,396,965 | A | 3/1995 | Hall et al. | |
| 5,505,261 | A | 4/1996 | Huber et al. | |
| 5,535,767 | A | 7/1996 | Schnatzmeyer et al. | |
| 5,562,357 | A | 10/1996 | Sandell | |
| 5,623,966 | A | 4/1997 | Rodger | |
| 5,713,423 | A | 2/1998 | Martin et al. | |
| 5,862,866 | A | 1/1999 | Springer | |
| RE36,166 | E * | 3/1999 | Johns | E21B 4/16 173/17 |
| 5,906,238 | A | 5/1999 | Carmody et al. | |
| 5,957,207 | A | 9/1999 | Schnatzmeyer | |
| 5,957,208 | A | 9/1999 | Schnatzmeyer | |
| 5,992,520 | A | 11/1999 | Schultz et al. | |
| 6,073,698 | A | 6/2000 | Schultz et al. | |
| 6,082,458 | A | 7/2000 | Schnatzmeyer | |
| 6,260,616 | B1 | 7/2001 | Carmody et al. | |
| 6,334,486 | B1 | 1/2002 | Carmody et al. | |
| 6,371,208 | B1 | 4/2002 | Norman et al. | |
| 6,450,255 | B2 | 9/2002 | Carmody et al. | |
| 6,484,800 | B2 | 11/2002 | Carmody et al. | |
| 6,612,547 | B2 | 9/2003 | Carmody et al. | |
| 6,659,202 | B2 | 12/2003 | Runquist et al. | |
| 6,668,935 | B1 | 12/2003 | McLoughlin et al. | |
| 6,715,558 | B2 | 4/2004 | Williamson | |
| 6,722,439 | B2 | 4/2004 | Garay et al. | |
| 6,860,330 | B2 | 3/2005 | Jackson | |
| 6,892,818 | B2 | 5/2005 | Mentesh et al. | |
| 6,966,380 | B2 | 11/2005 | McLoughlin et al. | |
| 6,973,974 | B2 | 12/2005 | McLoughlin et al. | |
| 7,025,140 | B2 | 4/2006 | McGee | |
| 7,134,514 | B2 | 11/2006 | Riel et al. | |
| 7,139,219 | B2 | 11/2006 | Kolle et al. | |
| 7,152,688 | B2 | 12/2006 | Richards | |
| 7,152,700 | B2 | 12/2006 | Church et al. | |
| 7,207,603 | B2 | 4/2007 | Segreto | |
| 7,225,875 | B2 | 6/2007 | Steele et al. | |
| 7,258,323 | B2 | 8/2007 | Dwivedi | |
| 7,350,565 | B2 | 4/2008 | Hall et al. | |
| 7,377,327 | B2 | 5/2008 | Jackson | |
| 7,389,830 | B2 | 6/2008 | Turner et al. | |
| 7,429,030 | B2 | 9/2008 | Dwivedi | |
| 7,451,825 | B2 | 11/2008 | Jonas | |
| 7,455,115 | B2 | 11/2008 | Loretz et al. | |
| 7,503,395 | B2 | 3/2009 | Meijer et al. | |
| 7,549,485 | B2 | 6/2009 | Radford et al. | |
| 7,575,058 | B2 | 8/2009 | Franco et al. | |
| 7,581,602 | B2 | 9/2009 | Lorger et al. | |
| 7,681,666 | B2 | 3/2010 | Radford et al. | |
| 7,712,540 | B2 | 5/2010 | Loretz et al. | |
| 7,748,478 | B2 | 7/2010 | Swadi | |
| 7,762,334 | B2 | 7/2010 | Posluszny et al. | |
| 7,762,356 | B2 | 7/2010 | Turner et al. | |
| 7,766,084 | B2 | 8/2010 | Churchill | |
| 7,770,645 | B2 | 8/2010 | Jeffryes | |
| 7,775,233 | B2 | 8/2010 | Baugh | |
| 7,832,473 | B2 | 11/2010 | Pensgaard | |
| 7,849,936 | B2 | 12/2010 | Hutton | |
| 7,870,906 | B2 | 1/2011 | Ali | |
| 7,939,142 | B2 | 5/2011 | Blue et al. | |
| 7,954,561 | B2 | 6/2011 | Tulloch et al. | |
| 7,980,265 | B2 | 7/2011 | Holmes et al. | |
| RE42,772 | E | 10/2011 | McGee | |
| 8,047,304 | B2 | 11/2011 | Radford | |
| 8,109,330 | B1 | 2/2012 | Miller | |
| 8,141,648 | B2 | 3/2012 | Darnell et al. | |
| 8,141,657 | B2 | 3/2012 | Hutton | |
| 8,186,444 | B2 | 5/2012 | Patel | |
| 8,196,679 | B2 | 6/2012 | Radford | |
| 8,220,563 | B2 | 7/2012 | Bangaru et al. | |
| 2004/0188146 | A1 | 9/2004 | Egerstrom | |
| 2006/0231150 | A1 | 10/2006 | Jamison | |
| 2008/0236842 | A1 | 10/2008 | Bhavsar et al. | |
| 2009/0095471 | A1 | 4/2009 | Guignard et al. | |
| 2009/0151790 | A1 | 6/2009 | Ranjan et al. | |
| 2009/0283331 | A1 | 11/2009 | Heath | |
| 2010/0012380 | A1 | 1/2010 | Swadi | |
| 2010/0044111 | A1 | 2/2010 | Marshall | |
| 2010/0270034 | A1 | 10/2010 | Clausen, Jr. | |
| 2010/0288557 | A1 | 11/2010 | Radford | |
| 2010/0294495 | A1 | 11/2010 | Clarkson et al. | |
| 2011/0000684 | A1 | 1/2011 | Charles et al. | |
| 2011/0088953 | A1 | 4/2011 | Rainey et al. | |
| 2011/0168408 | A1 | 7/2011 | Watson | |
| 2011/0192650 | A1 * | 8/2011 | Swadi | C22C 1/05 175/296 |
| 2011/0220415 | A1 | 9/2011 | Jin et al. | |
| 2011/0308861 | A1 | 12/2011 | Radford | |
| 2012/0205122 | A1 | 8/2012 | Peter et al. | |
| 2014/0182938 | A1 * | 7/2014 | Gan | E21B 4/14 175/57 |

FOREIGN PATENT DOCUMENTS

| | | |
|---|---|---|
| WO | 9904130 | 1/1999 |
| WO | 0131167 | 5/2001 |
| WO | 2008112332 | 9/2008 |
| WO | 2009009281 | 1/2009 |

OTHER PUBLICATIONS

Young, Lee W., International Search Report and Written Opinion of the International Searching Authority for PCT/US2014/065428, Jan. 15, 2015, pp. 1-8.

Young, Lee W., International Search Report and Written Opinion of the International Searching Authority for PCT/US2014/065424, Jan. 15, 2015, pp. 1-10.

* cited by examiner

TOP MOUNTED CHOKE FOR PERCUSSION TOOL

RELATED APPLICATIONS

The present application is related to U.S. patent application Ser. No. 14/079,323, entitled "Double Wall Flow Tube For Percussion Tool" and filed on Nov. 13, 2013, and U.S. patent application Ser. No. 14/079,362, entitled "Coating Of The Piston For A Rotating Percussion System In Downhole Drilling" and filed on Nov. 13, 2013, both of which are hereby incorporated by reference herein.

BACKGROUND

This invention relates generally to percussion tools used in downhole drilling. More particularly, this invention relates to an apparatus and method for controlling air flow within percussion tools, such as rotary bits, shear bits, and lighter hammer bits, used in downhole drilling.

Rotary drilling tools, such as rock bits, can benefit from percussive energy to improve drilling rate, or rate of penetration (ROP), and improve hole straightness. However, this percussive energy should be controlled. If the percussive energy is too little, the drilling tool will not create and/or propagate fractures in the rock. If the percussive energy is too much, the drilling tool life is unacceptably reduced due to bearing spalling, steel fatigue cracking, and/or other life reducing causes. Hence, to be an effective tool, the drilling tool should be efficient with low drill system pressure, but also should be able to limit percussive force at high drill system pressure.

A choke is commonly used to control the amount of air directed to the piston, which generates, or applies, the percussive force. The remaining amount of air that is not used, or not needed, to be directed to the piston flows into a bypass, or piston passageway, which is described in further detail below in conjunction with FIGS. 1A and 1B. In general, chokes having a larger internal diameter, which is less restrictive to the air flow, are used when air volume is high and less air should be directed to the piston or the required percussive force for the intended application is low. Thus, the excessive air that is not used flows through the choke via this larger internal diameter. Conversely, chokes having a smaller internal diameter, which is more restrictive to the air flow, are used when air volume is small and more air should be directed to the piston or the required percussive force for the intended application is high. Again, any excessive air that is not used flows through the choke via this smaller internal diameter.

The location and positioning of the choke is determined by the design of the percussion tool's internal air flow paths. Generally, this location for the choke is deep inside the percussion tool and not readily accessible without disassembly of the percussion tool. The disassembly of the percussion tool is cumbersome and time intensive, resulting in excessive lost drilling time and increased operational costs. Typically, the percussion tool is disassembled from the drill string or other downhole tool, sent to a shop, and further disassembled to gain access to the choke. The choke may need maintenance due to blockage or due to needing to change out the choke with a different internal diameter choke, for example. There is a need to develop a percussion tool with a choke which can be quickly replaced and/or adjusted without disassembly of the percussion tool.

FIG. 1A is a longitudinal cross-sectional view of a portion of a conventional downhole percussion tool 10 in accordance with the prior art. FIG. 1B is a longitudinal cross-sectional view of a remaining portion of the conventional downhole percussion tool 10 of FIG. 1A whereby FIG. 1A is intended to be joined to FIG. 1B along common line a-a in accordance with the prior art. The conventional downhole percussion tool 10 is described in detail in U.S. Pat. No. 7,377,338, which issued to Bassinger on May 27, 2008, and is incorporated by reference herein in its entirety. Thus, the conventional downhole percussion tool 10 is briefly described herein for the sake of describing airflow therein and the positioning of the choke 74, or orifice plug. Referring to FIGS. 1A and 1B, the conventional downhole percussion tool 10 includes a tool cylinder or housing 12, a rear adapter or sub 24, a check valve 36, a piston 44, a drive sub 106, and an integrated claw bit 92. Although an integrated claw bit is illustrated within FIG. 1B, a bit sub (not shown) capable of receiving a claw bit, or other bit type such as a rotary or fixed cutter bit, can be used in lieu of the integrated claw bit 92. Once the conventional downhole percussion tool 10 is assembled, a top pressure fluid chamber 78, an annular chamber 97, and a bottom pressure fluid chamber 88 are formed.

The sub 24 includes a sub passage 30 extending longitudinally therein. The check valve 36 is coupled at an end of the sub passage 30 and is positioned within the housing 12 once the sub 24 is threadedly coupled to an end of the housing 12. The check valve 36 allows for pressurized fluid to flow from the sub passage 30 into the housing 12; however, the check valve 36 prevents pressurized fluid from flowing from the housing 12 to the sub passage 30.

Similarly, the drive sub 106 is threadedly coupled to an opposing end of the housing 12. The integrated claw bit 92 is movably coupled within the drive sub 106 at the opposing end of the housing 12. The integrated claw bit 92 includes a bit passage 118 extending longitudinally therein and is in communication with one or more secondary bit passages 120, which are in communication with an environment external to the bit 92. The integrated claw bit 92 is capable of moving in at least an axial direction and may be capable of moving in a rotational manner as well. When the integrated claw bit 92 is in contact with the bottom of the formation or when there is a significant upward force acting upon the integrated claw bit 92, the integrated claw bit 92 is in the dash-lined position as shown in FIG. 1B. Conversely, when the integrated claw bit 92 is not in contact with the bottom of the formation or there is no significant upward force acting upon the integrated claw bit 92, the integrated claw bit 92 is in the solid-lined position as shown in FIG. 1B.

The piston 44 is a single-walled tube that includes a piston passage 70 extending substantially centrally therethrough. An orifice plug 74, or choke valve, is positioned within the piston passage 70 at a top end of the piston 44. The piston passage 70 is in fluid communication with piston base passage 72 formed within an opposing end of the piston 44. The piston 44 also includes at least two pressurized fluid inlet ports 82 formed along a top portion of a sidewall of the piston 44 and extending into an interior of the piston 44. The piston 44 further includes pressurized fluid conducting piston passageways 80 extending from the pressurized fluid inlet ports 82 to the opposing end of the piston 44. Piston 44 further includes one or more exhaust passages 96 that extend from the piston base passage 72 to the annular chamber 97 formed between the piston 44 and the housing 12. The exhaust passages 96 are offset from the pressurized fluid conducting piston passageways 80. The piston 44 is movably positioned within the housing 12. Once the piston 44 is properly assembled within the housing 12, the top pressure fluid chamber 78, the annular chamber 97, and the bottom pressure fluid chamber 88 are formed. The top pressure fluid chamber 78 is formed between the one end of the piston 44 having the orifice plug 74 and the check valve 36. The annular chamber 97 is formed between a portion of the perimeter of the piston 44 and the housing 12. The bottom pressure fluid chamber 88 is formed between the opposing end of the piston 44 and the integrated claw bit 92.

During operation of the conventional downhole percussion tool 10, the tool 10 is placed in a position such that the bit 92 is urged upwardly to the position indicated by the dashed lines in FIG. 1B and the piston 44 will be urged to the position shown by the solid lines in FIGS. 1A and 1B. In this position, the flow of high pressure fluid from top pressure fluid chamber 78 to annular chamber 97 is terminated since a reduced diameter portion 56 of the piston 44 is in close fitting relationship with a sleeve 62 positioned within the housing 12 and about the perimeter of a portion of the piston 44. In this condition, pressure fluid is still communicated through pressurized fluid conducting piston passageways 80 to bottom pressure fluid chamber 88 while pressure fluid is vented from annular chamber 97 through exhaust passages 96 to the exterior of the tool 10 by way of the bit passage 118 and secondary bit passages 120. Thus, a resultant force is exerted on the piston 44 driving it upwardly, viewing FIGS. 1A and 1B, until the reduced diameter portion 56*a* of the piston 44 is positioned such that the communication of high pressure fluid to pressurized fluid inlet ports 82, pressurized fluid conducting piston passageways 80, and bottom pressure fluid chamber 88 is cut-off. A resultant pressure fluid force acting on piston 44 will continue to drive the piston 44 upwardly, viewing FIGS. 1A and 1B, until the pressure fluid from bottom pressure fluid chamber 88 is able to vent through bit passage 118 and secondary bit passages 120. This occurs when the bottom of the piston 44 is raised elevationally above the top of a tube 124, which is positioned at least partially within bit passage 118 and extends outwardly from the top of the bit 92. In this condition, a net resultant pressure fluid force acting on the top surface of the piston 44 is sufficient to drive the piston 44 downwardly to deliver an impact blow to the top surface of the bit 92 and the cycle just described will then repeat itself rapidly and in accordance with the design parameters of the tool 10.

As seen in FIGS. 1A and 1B along with the description provided, it can be seen that the choke valve 74 is coupled to the movable piston 44 and is positioned at the top end of the piston passage 70. Further, the check valve 36 is positioned upstream of the choke valve 74 and is coupled to at the end of the sub passage 30. Once the tool 10 is decoupled from the drill string or other downhole tool, an operator is prevented from accessing the choke valve 74 through the sub passage 30 since the check valve blocks access to the choke valve 74. Hence, the tool 10 must be disassembled for an operator to service the choke valve 74 and/or replace the choke valve 74, which results in increased costs and increased time delay in drilling the hole.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein:

FIG. 1A is intended to be joined to FIG. 1B along common line a-a in accordance with the prior art;

FIGS. 4A-4J-2 are cross-sectional views of the percussion tool of FIG. 3 without the bit illustrating the operation of the percussion tool in accordance with an exemplary embodiment of the present invention;

The drawings illustrate only exemplary embodiments of the invention and are therefore not to be considered limiting of its scope, as the invention may admit to other equally effective embodiments.

DETAILED DESCRIPTION OF THE INVENTION

This invention relates generally to percussion tools used in downhole drilling. More particularly, this invention relates to an apparatus and method for controlling air flow within percussion tools, such as rotary bits, shear bits, and lighter hammer bits, used in downhole drilling. Although the description provided below is related to a percussion tool with a rotary bit, exemplary embodiments of the invention relate to any downhole percussion tool including, but not limited to, percussion tools having a shear bit, a lighter hammer bit, or other known bit used in percussion tools.

Figure 1A:
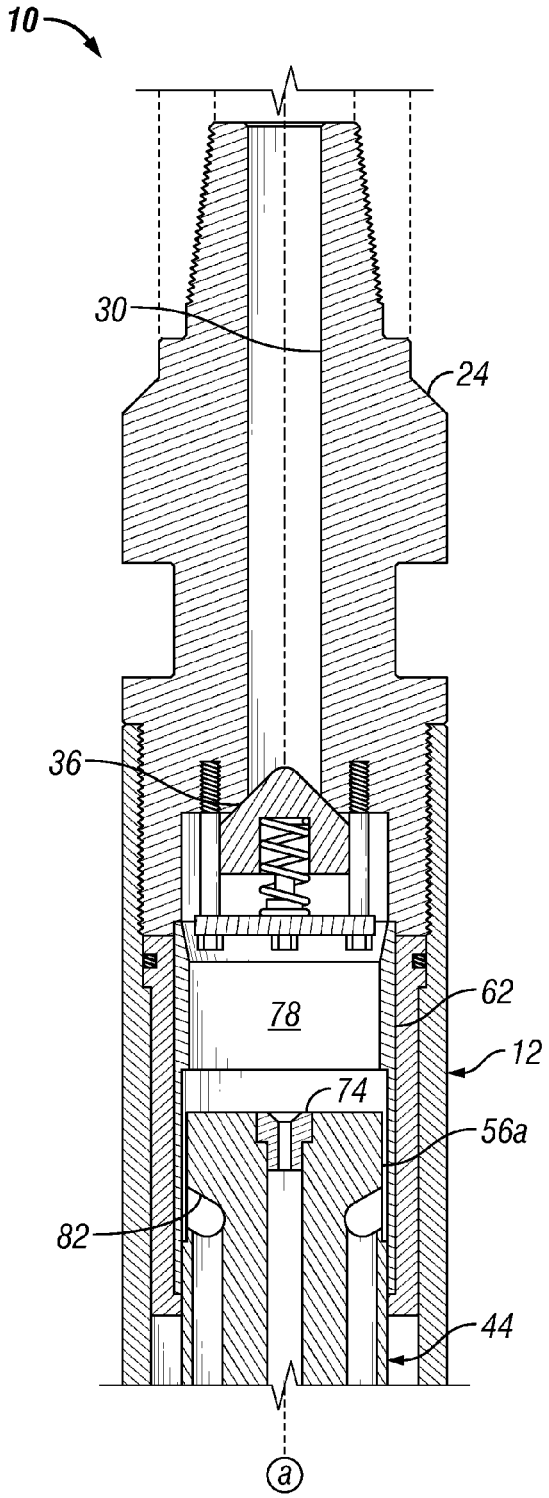
FIG. 1A (Prior Art)
FIG. 1A is a longitudinal cross-sectional view of a portion of a conventional downhole percussion tool in accordance with the prior art.
Figure 1B:
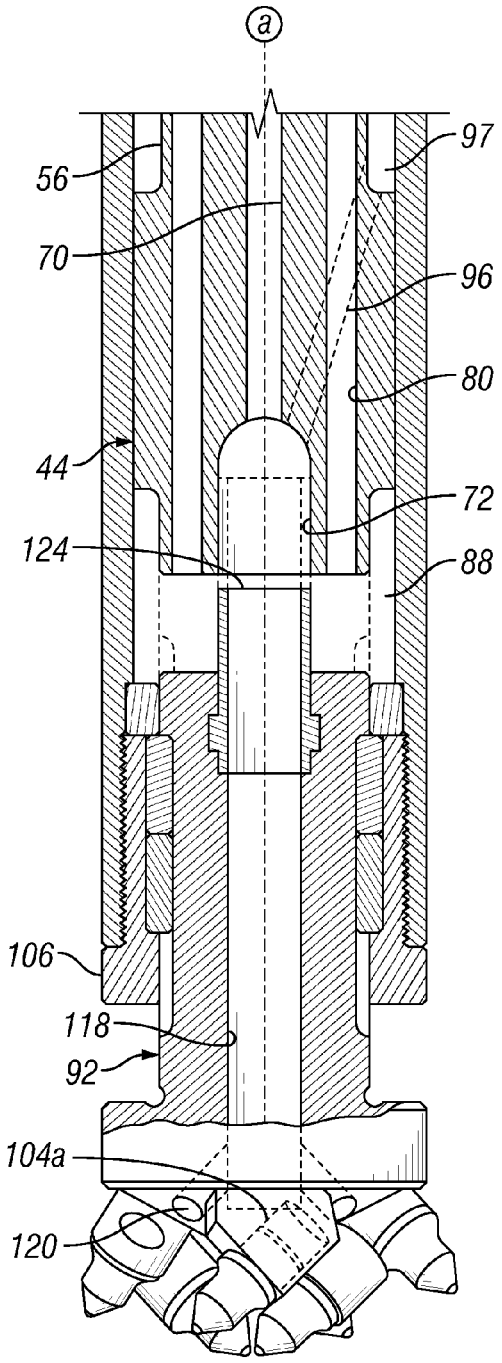
FIG. 1B (Prior Art)
FIG. 1B is a longitudinal cross-sectional view of a remaining portion of the conventional downhole percussion tool of FIG. 1A whereby
Figure 2:
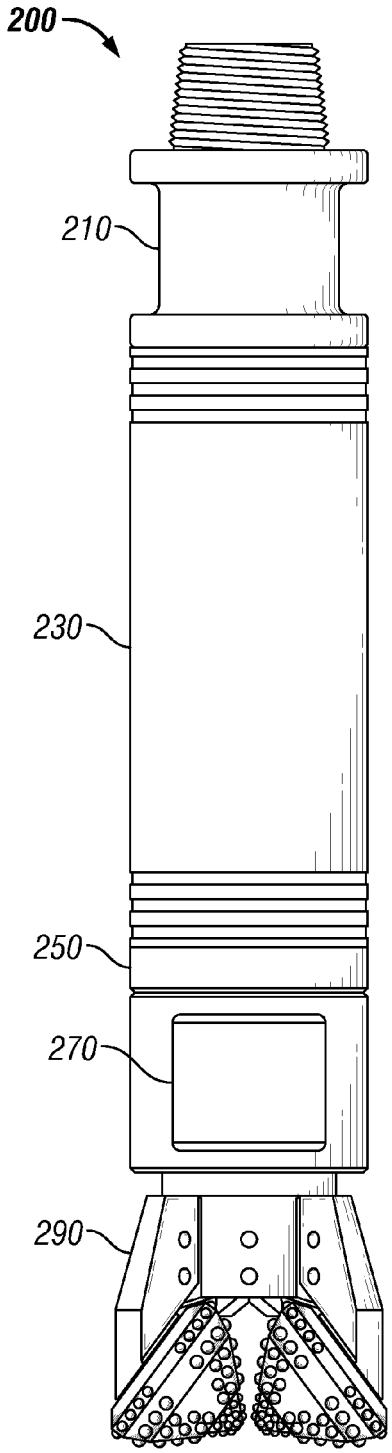
FIG. 2 is a side view of a percussion tool in accordance with an exemplary embodiment of the present invention.
Figure 3:
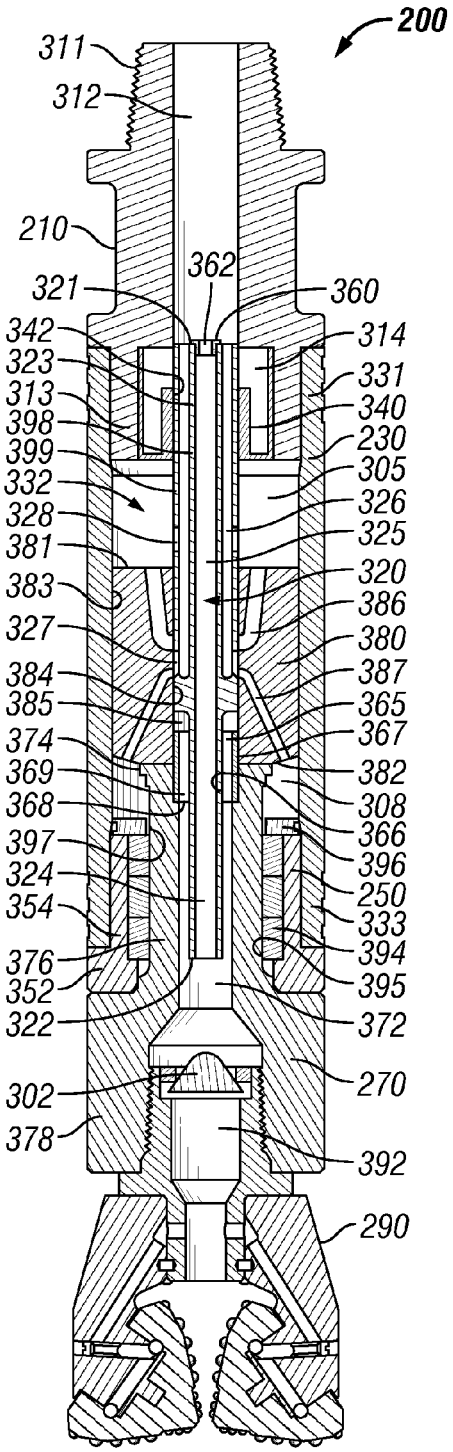
FIG. 3 is a cross-sectional view of the percussion tool of FIG. 2 in accordance with an exemplary embodiment of the present invention.

FIG. 2 is a side view of a percussion tool 200 in accordance with an exemplary embodiment of the present invention. FIG. 3 is a cross-sectional view of the percussion tool 200 in accordance with an exemplary embodiment of the present invention. Referring to FIGS. 2 and 3, the percussion tool 200 includes a top sub 210, a case 230, a drive sub 250, a mandrel 270, and a bit 290, which are viewable and accessible from exterior of the percussion tool 200. The percussion tool 200 further includes a feed tube 320, a feed tube mount 340, a choke 360, a piston 380, one or more drive lugs 394, an exhauster 365, a split retaining ring 396, and a check valve 302, which are all positioned internally of the percussion tool 200. Although certain components have been mentioned, greater or fewer components may be included in the percussion tool 200 without departing from the scope and spirit of the exemplary embodiment. Further, one or more components may be combined or separated from another mentioned component without departing from the scope and spirit of the exemplary embodiment. Once the percussion tool 200 is assembled, a top pressure fluid chamber 305 and a bottom pressure fluid chamber 308 are formed.

The top sub 210 includes a top end 311, a bottom end 313, a sub passage 312 extending longitudinally therein from the top end 311 towards the bottom end 313, and a secondary sub passage 314 extending from the end of the sub passage 312 to the bottom end 313. The top end 311 is threaded and is coupleable to a drill string (not shown) or some other down hole tool according to certain exemplary embodiments. Similarly, the bottom end 313 also is threaded and is coupled to the case 230 according to certain exemplary embodiments. The secondary sub passage 314 is in fluid communication with the sub passage 312. The secondary sub passage 314 is larger in diameter than the sub passage 312 according to some exemplary embodiments. The secondary sub passage 314 houses a portion of the feed tube 320, at least a portion of the feed tube mount 340, and the choke 360 depending upon the length and positioning of the feed tube 320 according to certain exemplary embodiments. In certain other exemplary embodiments, the choke 360 is housed within the sub passage 312 or a combination of the sub passage 312 and the secondary sub passage 314 according to certain exemplary embodiments. Although not illustrated in this exemplary embodiment, the check valve 302 is optionally coupled to the top sub 210 either within the sub passage 312 or within the secondary sub passage 314 above the choke 360 and prevents the upward flow of pressurized fluid, such as air, from the top pressure fluid chamber 305 and/or the feed tube 320 to the drill string or other down hole tool positioned above the top sub 210. This optional exemplary embodiment is illustrated and described with respect to FIGS. 5-7B below. Hence, in this optional exemplary embodiment, the check valve 302 allows for pressurized fluid to flow in the direction from the sub passage 312 to the case 230; however, the check valve 302 prevents pressurized fluid from flowing in the opposite direction. In these exemplary embodiments, the check valve 302 is removable without disassembly of the percussion tool 200 or is able to be locked open, thereby providing access to the choke 360 for replacement or service. In the current exemplary embodiment illustrated in FIG. 3, however, this check valve 230 is positioned within the bit 290, which is described in further detail below. Thus, since the check valve 302 has been repositioned from the positioning in the prior art, access to the choke 360 is available without disassembly of the percussion tool 200.

The case 230 is tubularly shaped and includes a top end 331, a bottom end 333, and a case passageway 332 extending from the top end 331 to the bottom end 333. The case passageway 332 has a variable internal diameter along its length according to certain exemplary embodiments, however, this internal diameter is not variable in other exemplary embodiments. The top end 331 is threaded and is coupled to the bottom end 313 of the top sub 210. Similarly, the bottom end 333 also is threaded and is coupled to the drive sub 250 according to certain exemplary embodiments. The case 230 houses at least a portion of the top sub 210, the feed tube mount 340, the feed tube 320, the piston 380, one or more drive lugs 394, the exhauster 365, the split retaining ring 396, a portion of the drive sub 250, and a portion of the mandrel 270. Once the components of the percussion tool 200 are assembled, the top pressure fluid chamber 305 and the bottom pressure fluid chamber 308 are formed within the case 230.

The drive sub 250 is tubularly shaped and includes a first portion 352 and a second portion 354. The first portion 352 has an outer diameter equal to the outer diameter of the case 230. The second portion 354 extends substantially orthogonally away from the first portion 352 and has an outer diameter less than the outer diameter of the first portion 352 and an inner diameter greater than the inner diameter of the first portion 352. According to certain exemplary embodiments, the second portion 354 is threaded and coupled to the bottom end 333 of the case 230. Once the drive sub 250 is assembled to the case 230, the outer surfaces of both the first portion 352 of the drive sub 250 and the case 230 are substantially aligned. The drive sub 250 houses the one or more drive lugs 394 and a portion of the mandrel 270 and the feed tube 320 according to certain exemplary embodiments.

The mandrel 270 is a substantially solid component having a mandrel passageway 372 extending axially therethrough. The mandrel passageway 372 houses a portion of the feed tube 320 and is in fluid communication with the sub passage 312 via the feed tube 320, which is described in greater detail below, in accordance with certain exemplary embodiments. The mandrel 270 further includes a top portion 374, a bottom portion 378, and a middle portion 376 extending from the top portion 374 to the bottom portion 378. The middle portion 376 has an outer diameter less than the outer diameters of both the top portion 374 and the bottom portion 378. The bottom portion 378 has an outer diameter equal to the outer diameter of the first portion 352 of the drive sub 250. Further, the top portion 374 has an outer diameter less than the outer diameter of the bottom portion 378 and greater than the outer diameter of the middle portion 376. The mandrel 270 houses a portion of the feed tube 320 and at least a portion of the exhauster 365. Once the mandrel 270 is assembled to form the percussion tool 200, the mandrel 270 is axially moveable with respect to both the case 230 and the drive sub 250 and a portion of the mandrel 270 is inserted and housed within the case 230. The bottom portion 378 of the mandrel 270 is positioned adjacent to the first portion 352 of the drive sub 250 when the bit 290 is placed within the formation in contact with the bottom of the hole and with a downward force applied onto the bottom of the hole. However, the bottom portion 378 of the mandrel 270 is not positioned adjacent to the first portion 352 of the drive sub 250 when the bit 290 is placed within the formation and is not in contact with the bottom of the hole. The mandrel passageway 372 has a larger diameter at the bottom portion 378 of the mandrel 270 and is configured to receive a portion of the bit 290 therein according to certain exemplary embodiments. In certain of these exemplary embodiments, the lower portion of the mandrel passageway 372 is threaded and engages with a portion of the bit 290. However, in alternative exemplary embodiments, the bit 290 and the mandrel 270 are formed as an integral component, such as when the percussion tool includes a hammer bit.

Bit 290 is a roller cone bit that is coupled to the mandrel 270 within the lower portion of the mandrel passageway 372 according to certain exemplary embodiments. The bit 290 is threadedly engaged to the mandrel 270 according to some exemplary embodiments. Although the bit 290 is illustrated as a roller cone bit in certain exemplary embodiments, the bit 290 is a different type of bit, such as a polycrystalline diamond cutter (PDC) bit, or other type of drag bit or fixed cutter bit. Alternatively, in other exemplary embodiments, the bit 290 is integrally formed with the mandrel 270, such as a hammer bit, as a single component. Bit 290 includes a bit passageway 392 extending therein and in fluid communication with the mandrel passageway 372. The bit passageway 392 communicates pressurized fluid, such as air, from the mandrel passageway 372 to an environment external of the bit 290. Further, according to certain exemplary embodiments, the check valve 302 is coupled within the bit passageway 392 of the bit 290. The check valve 302 is designed to allow flow from the mandrel passageway 372 to the environment external to the bit 290; however, the check valve 302 prevents flow in the reverse direction. As previously mentioned, according to some alternative exemplary embodiments as illustrated and described with respect to FIGS. 5-7B, this check valve 302 is positioned upstream, or vertically above, the choke 360 when the check valve 302 is replaceable or is capable of being locked open.

As previously mentioned, the percussion tool 200 further includes the feed tube 320, the feed tube mount 340, the choke 360, the piston 380, one or more drive lugs 394, the exhauster 365, and the split retaining ring 396. According to certain exemplary embodiments, the feed tube 320 is a double-wall feed tube and is tubular in shape. The feed tube 320 includes a top end 321, a bottom end 322, an upper portion 323, and a lower portion 324. The feed tube 320 also includes an inner wall 398 and an outer wall 399. The upper portion 323 extends from the top end 321 towards the bottom end 322 and the lower portion 324 extends from the upper portion 323 to the bottom end 322. According to certain exemplary embodiments, the upper portion 323 has a greater outer diameter than the lower portion 324. The feed tube 320 includes a central feed tube channel 325 extending from the top end 321 to the bottom end 322 and is defined by the inner wall 398. The central feed tube channel 325 communicates pressurized fluid from the sub passage 312 to the mandrel passageway 372. The feed tube 320 also includes an outer feed tube channel 326, which extends from the top end 321 towards the lower portion 324, but remains within the upper portion 323 according to certain exemplary embodiments. The outer feed tube channel 326 is defined by the outer wall 399 and the inner wall 398 and is positioned therebetween. However, in other exemplary embodiments, the outer feed tube channel 326 extends into the lower portion 324 but not through the feed tube 320. The outer feed tube channel 326 circumferentially surrounds a portion of the length of the central feed tube channel 325; however, in other exemplary embodiments, the outer feed tube channel 326 does not circumferentially surround a portion of the central feed tube channel 325. For example, the outer feed tube channel 326 may be a single channel extending from the top end 321 or may be several discrete channels extending from the top end 321. Additionally, the feed tube 320 includes one or more first openings 327 and one or more second openings 328 positioned about the perimeter of the upper portion 323 through the outer wall 399. However, in other exemplary embodiments, some or all of these openings 327, 328 are positioned about the perimeter of the lower portion 324 when the outer feed tube channel 326 extends into the lower portion 324. The first openings 327 communicate pressurized fluid from within the outer feed tube channel 326 to the bottom pressure fluid chamber 308 through an interior of the piston 380, while the second openings 328 communicate pressurized fluid from within the outer feed tube channel 326 to the top pressure fluid chamber 305 via the interior of the piston 380. According to some exemplary embodiments, the first openings 327 are radially aligned with one another at substantially the same elevation; however, in other exemplary embodiments, one or more first openings 327 are not radially aligned with one another at the same elevation. Similarly, according to some exemplary embodiments, the second openings 328 are radially aligned with one another at substantially the same elevation; however, in other exemplary embodiments, one or more second openings 328 are not radially aligned with one another at the same elevation. Yet, in other exemplary alternative exemplary embodiments, there are only one or more first openings 327 and no second openings 328 as the first openings are configured to convey pressurized fluid either to the bottom pressure fluid chamber 308 or to the top pressure fluid chamber 305 depending upon the elevational positioning of the piston 380. In other exemplary embodiments, the first openings 327 communicate pressurized fluid from within the outer feed tube channel 326 to the top pressure fluid chamber 305 through an interior of the piston 380, while the second openings 328 communicate pressurized fluid from within the outer feed tube channel 326 to the bottom pressure fluid chamber 308 via the interior of the piston 380.

The feed tube 320 extends from within a portion of the top sub 210 to within a portion of the mandrel 270 and facilitates the communication of pressurized fluid from the sub passage 312 of the top sub 210 to the mandrel passageway 372 of the mandrel 270 and also facilitates the communication of pressurized fluid from the sub passage 312 of the top sub 210 to either to the bottom pressure fluid chamber 308 or to the top pressure fluid chamber 305 depending upon the elevational positioning of the piston 380. According to some exemplary embodiments, the top end 321 of the feed tube 320 extends into the sub passage 312. According to some exemplary embodiments, the outer diameters of the top end 321 of the feed tube 320 and the sub passage 312 are substantially the same such that the top end 321 frictionally fits within the sub passage 312. The feed tube 320 is surrounded by a portion of the top sub 210, the casing 230, a portion of the drive sub 250, a portion of the mandrel 270, the feed tube mount 340, the piston 380, the one or more drive lugs 394, the exhauster 365, and the split retaining ring 396. According to certain exemplary embodiments, the feed tube 320 is fixedly coupled within the interior of the percussion tool 200 using at least one of the feed tube mount 340 and/or the exhauster 365. For example, in one or more exemplary embodiments, the feed tube 320 frictionally fits within the feed tube mount 340 and/or the exhauster 365.

The feed tube mount 340 is annularly shaped with a feed tube mount passageway 342 extending longitudinally therethrough according to certain exemplary embodiments. The feed tube mount 340 is positioned within the secondary sub passage 314 according to some exemplary embodiments, but can be positioned elsewhere, such as within the top pressure fluid chamber 305 in other exemplary embodiments. The feed tube mount passageway 342 receives at least a portion of the feed tube 320 and may assist in mounting the feed tube 320 within the percussion tool 200. According to certain exemplary embodiments, the feed tube 320 extends entirely through the feed tube mount 340. However, according to some exemplary embodiments, the feed tube 320 is a single-walled feed tube or is omitted as the function of the feed tube is carried out as described in the prior art.

The choke 360 also is annularly shaped and forms a plug that fits into the central feed tube channel 325 at the top end 321 of the feed tube 320. The choke 360 includes a choke passageway 362 formed longitudinally therethrough. The dimension, or diameter, of this choke passageway 362 limits the amount of pressurized fluid flowing into the central feed tube channel 325 from the sub passage 312. The pressurized fluid generally flows from the sub passage 312 into the outer feed tube channel 326 and then into either the bottom pressure fluid chamber 308 or to the top pressure fluid chamber 305 depending upon the elevational positioning of the piston 380. However, the excess pressurized fluid flows into the central feed tube channel 325 through the choke 360. The choke 360 is replaceable depending upon the desired restriction, which determines the amount of pressurized fluid that flows into the central feed tube channel 325 through the choke 360. For example, less pressurized fluid flows into the central feed tube channel 325 through the choke 360 when the dimension, or diameter, of the choke passageway 362 is small when compared to when the dimension, or diameter, of the choke passageway 362 is larger. The replacement of the choke 360 is fairly simple and does not require several components of the percussion tool 200 to be dismantled considering that the check valve 302 has been relocated to downstream of the choke 360 according to some of the exemplary embodiments. The top sub 210, along with the remaining components of the percussion tool 200 positioned below the top sub 210, is threadedly removed, or disengaged, from the drill string, or other down hole tool, that it is coupled to. Once the top sub 210 is disengaged, an operator is able to remove the choke 360 by accessing it through the sub passage 312 from the top end 311. Once the operator removes the choke 360, the operator is able to install a different choke of a different size, or the same size if choke 360 has been damaged, depending upon the operating requirements through the same sub passage 312 from the top end 311. Once the choke 360 has been replaced, the top sub 210, along with the remaining attached components, are threadedly coupled, or re-engaged, to the drill string, or other down hole tool, that it is to be coupled to. Alternatively, if the check valve 302 remained in the position as shown in the prior art, i.e. upstream of the choke, the check valve 302 would need to be locked open or removable without dismantling of the percussion tool 200, thereby allowing repair or replacement of the choke also without dismantling of the percussion tool 200. This is illustrated and described with respect to FIGS. 5-7B below.

Piston 380 is annularly shaped and includes a top end 381, a bottom end 382, an exterior surface 383, and an interior surface 384 that defines a piston passageway 385 extending longitudinally through the piston 380. The piston 380 further includes at least one first pressurized fluid conduit 386 that extends from the interior surface 384 to the top end 381 and at least one second pressurized fluid conduit 387 that extends from the interior surface 384 to the bottom end 382. Further, the piston 380 includes at least one top exhaust conduit 430 (FIG. 4B-2) that extends from the top end 381 to a lower portion of the interior surface 384 such that the top exhaust conduit 430 (FIG. 4B-2) can communicate pressurized fluid from the top pressure fluid chamber 305 to the exhauster 365 when the at least one second pressurized fluid conduit 387 communicates pressurized fluid to the bottom pressure fluid chamber 308. The piston 380 is positioned within the case passageway 332 such that the interior surface 384 is positioned slidably and in contact with the feed tube 320 and the exterior surface 383 is positioned slidably and in contact with the casing 230. Once the piston 380 is slidably positioned within the case passageway 332, the top pressure fluid chamber 305 is formed within the case passageway 332 adjacently above the top end 381 and the bottom pressure fluid chamber 308 is formed within the case passageway 332 adjacently below the bottom end 382. As the piston slidably moves upward towards the top sub 210, the volume of the top pressure fluid chamber 305 decreases while the volume of the bottom pressure fluid chamber 308 increases. Conversely, as the piston 380 slidably moves downward towards the mandrel 270, the volume of the top pressure fluid chamber 305 increases while the volume of the bottom pressure fluid chamber 308 decreases. The piston 380 is used to deliver a downward force onto the mandrel 270 when the bottom end 382 makes downward contact with the mandrel 270. The piston 380 is forced back up and then cycles down again to make contact with the mandrel 270. This cycling of the piston 380 continues until the flow of pressurized fluid through the outer feed tube channel 326 is stopped. The details of this piston 380 operation is provided below in conjunction with FIGS. 4A-J in accordance with one or more exemplary embodiments.

One or more drive lugs 394 are annularly shaped, stacked on top of one another, and positioned between and in contact with the second portion 354 of the drive sub 250 and the middle portion 376 of the mandrel 270. Each drive lug 394 includes a drive lug passageway 395 that extends longitudinally therethrough and receives a portion of the mandrel 270 therein. Specifically, once the drive lugs 394 and the mandrel 270 are properly installed, the middle portion 376 of the mandrel 270 slidably engages with the one or more drive lugs 394 through the drive lug passageway 395. When an upward force is placed onto the bottom of the bit 290, the mandrel 270 slidably moves toward the top sub 210 such that the bottom portion 378 of the mandrel 270 and the drive sub 250 are adjacent and/or in contact with one another. Conversely, when an upward force is not placed onto the bottom of the bit 290, the mandrel 270 slidably moves away the top sub 210 such that the bottom portion 378 of the mandrel 270 and the drive sub 250 are not adjacent and/or not in contact with one another. According to the exemplary embodiment, three drive lugs 394 are shown; however, greater or fewer drive lugs 394 are used in other exemplary embodiments.

The split retaining ring 396 also is annularly shaped, stacked on top of one of the drive lugs 394 and the second portion 354 of the drive sub 250, and positioned between and in contact with the lower portion of the case 230 and the middle portion 376 of the mandrel 270. The split retaining ring 396 includes a split retaining ring passageway 397 that extends longitudinally therethrough and receives a portion of the mandrel 270 therein. Specifically, once the split retaining ring 396 and the mandrel 270 are properly installed, the middle portion 376 of the mandrel 270 slidably engages with the split retaining ring 396 through the split retaining ring passageway 397. When an upward force is placed onto the bottom of the bit 290, the mandrel 270 slidably moves toward the top sub 210 such that the top portion 374 of the mandrel 270 and the split retaining ring 396 are not adjacent and/or in contact with one another. Conversely, when an upward force is not placed onto the bottom of the bit 290, the mandrel 270 slidably moves away the top sub 210 such that the top portion 374 of the mandrel 270 and the split retaining ring 396 are adjacent and/or in contact with one another. The split retaining ring 396 prevents the mandrel 270 and the bit 290 from disengaging from the remaining components of the percussion tool 200, such as the casing 230. According to the exemplary embodiment, a single split retaining ring 396 is shown; however, greater number of split retaining rings 396 are used in other exemplary embodiments.

The exhauster 365 also is annularly shaped and is doubled-walled in accordance with some exemplary embodiments. The exhauster 365 includes an inner wall 366 and an outer wall 367. The inner wall 366 is tubularly shaped and defines an exhauster inner passageway 368 that extends longitudinally therethrough. The exhauster inner passageway 368 receives a portion of the lower portion 324 of the feed tube 320, which extends through the entire exhauster inner passageway 368. According to certain exemplary embodiments, the inner wall 366 provide some support to the feed tube 320. The outer wall 367 also is tubularly shaped and surrounds the inner wall 366. The outer wall 367 and the inner wall 366 collectively define an exhauster outer passageway 369 that extends longitudinally through the exhauster 365. The exhauster outer passageway 369 provides a pathway to exhaust pressurized fluid from the top fluid pressure chamber 305, through the piston 380, and into mandrel passageway 372 so that the pressurized fluid may exit to the external environment as the piston 380 moves upwardly towards the top sub 210. The exhauster 365 is positioned around a portion of the feed tube 320 and located between the feed tube 320 and a portion of the mandrel 270 and a portion of the piston 380 when the piston 380 is at its lower position. When the piston moves to its lower position, i.e. towards the mandrel 270, a portion of the exhauster 365 slides into the piston passageway 385, thereby preventing the exhaust of pressurized fluid from the bottom fluid pressure chamber 308.

Figures 2, 4B:
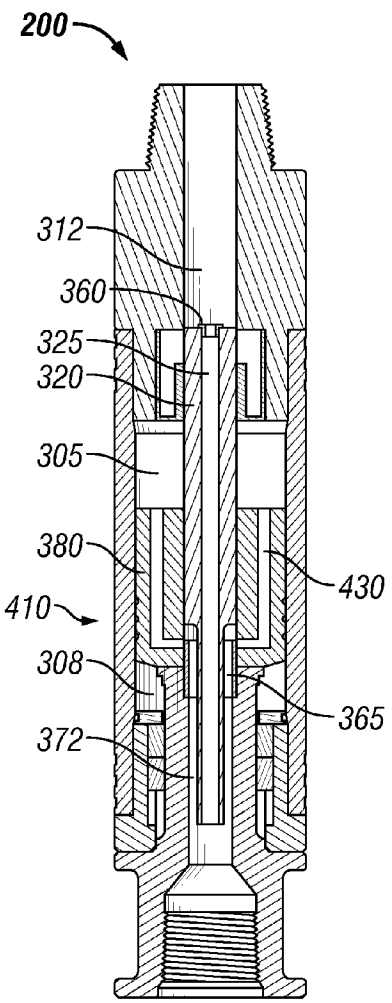
Figures 1, 4B:
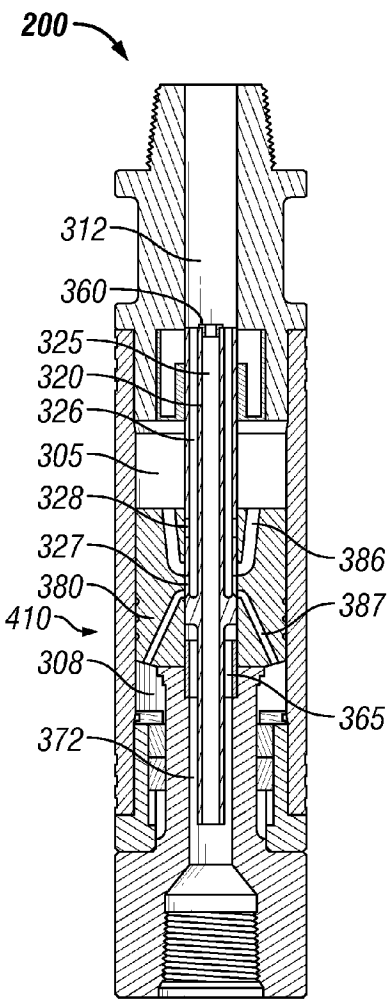
Figure 4A:
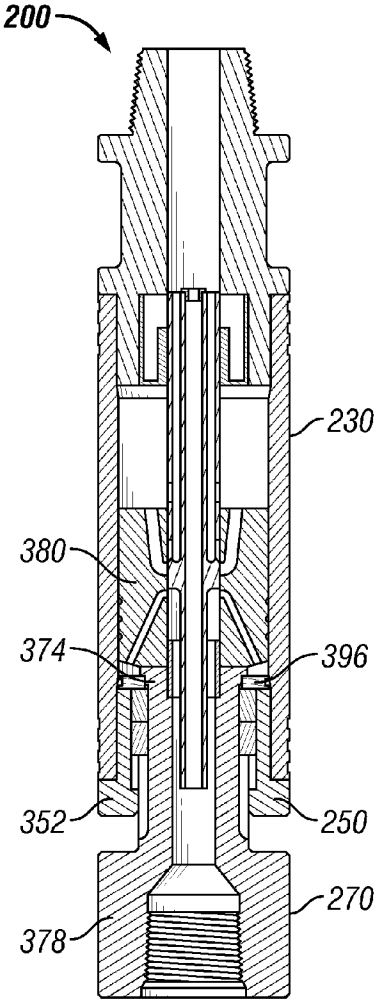

FIGS. 4A-4J-2 are cross-sectional views of the percussion tool 200 without the bit 290 (FIG. 2) illustrating the operation of the percussion tool 200 in accordance with an exemplary embodiment of the present invention. Specifically, FIG. 4A is a cross-sectional view of the percussion tool 200 when no upward force is exerted on the mandrel 270 in accordance with an exemplary embodiment of the present invention. Referring to FIG. 4A and as previously mentioned, the bottom portion 378 of the mandrel 270 is not positioned adjacent to the first portion 352 of the drive sub 250 when the bit 290 (FIG. 2) is placed within the formation and is not in contact with the bottom of the hole, for example, when an upward force is not exerted on the mandrel 270. Further, the top portion 374 of the mandrel 270 is in contact with the split retaining ring 396 and is prevented from being disengaged from the remaining components of the percussion tool 200. Hence, the mandrel 270 remains housed within at least a portion of the casing 230. Additionally, the piston 380 is positioned adjacently and in contact with the top portion 374 of the mandrel 270. However, once an upward force is exerted on the bottom of the mandrel 270, such as when the bit 290 (FIG. 2) is in contact with the bottom of the hole during drilling and as shown in each of FIGS. 4B-1-4J-2, the bottom portion 378 of the mandrel 270 is positioned adjacently and in contact with the first portion 352 of the drive sub 250.

For convenience purposes, it is assumed that an upward force is exerted on the bottom of the mandrel 270 in each of FIGS. 4B-1-4J-2 and therefore is not reiterated in the descriptions for each of those figures. Further, the non-illustration of the bit 290 (FIG. 2) in each of FIGS. 4B-1-4J-2 is not reiterated in the description for each of those figures. Either a bit, such as bit 290 (FIG. 2) is coupled to the mandrel 270 or an integrated bit, such as a hammer, is formed with the mandrel 270.

FIG. 4B-1 is a cross-sectional view of the percussion tool 200 with the piston 380 in the down position 410 and showing the positioning of the at least one first pressurized fluid conduit 386 and the at least one second pressurized fluid conduit 387 in accordance with an exemplary embodiment of the present invention. FIG. 4B-2 is a cross-sectional view of the percussion tool 200 with the piston 380 in the down position 410 and showing the positioning of the at least one top exhaust conduit 430 in accordance with an exemplary embodiment of the present invention. Referring to FIGS. 4B-1 and 4B-2, the piston 380 is positioned in the down position 410 and facilitates forming the top pressure fluid chamber 305 above it and the bottom pressure fluid chamber 308 below it, where the bottom pressure fluid chamber 308 is smaller in volume than the top pressure fluid chamber 305. At this down position 410, the second pressurized fluid conduits 387 within the piston 380 are in fluid communication with at least one respective first opening 327 of the feed tube 320 and hence is able to communicate pressurize fluid from the outer feed tube channel 326 to the bottom pressure fluid chamber 308. However, at this down position 410, the first pressurized fluid conduits 386 within the piston 380 are not in fluid communication with any of the second openings 328 of the feed tube 320 and hence is not able to communicate pressurize fluid from the outer feed tube channel 326 to the top pressure fluid chamber 305. Thus, only the bottom pressure fluid chamber 308 is filled with pressurized fluid while the top pressure fluid chamber 305 is not, when the piston 380 is at this down position 410. As the bottom pressure fluid chamber 308 is filled and the pressure therein increases, the piston 380 commences rising, thereby decreasing the volume of the top pressure fluid chamber 305 and increasing the volume of the bottom pressure fluid chamber 308. The pressurized fluid within the bottom pressure fluid chamber 308 does not exhaust through the exhauster 365 when the piston 380 is at this down position 410. As the volume on the top pressure fluid chamber 305 decreases, the fluid therein is exhausted to the outside environment through the at least one top exhaust conduit 430. This fluid proceeds from the top pressure fluid chamber 305, into the at least one top exhaust conduit 430, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). The excess pressurized fluid flowing from the sub passage 312, which is not used for filling the bottom pressure fluid chamber 308, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid enters only the bottom pressure fluid chamber 308 and therefore is not used to counteract, or work against, itself when being used to move the piston 380.

Figures 1, 4C:
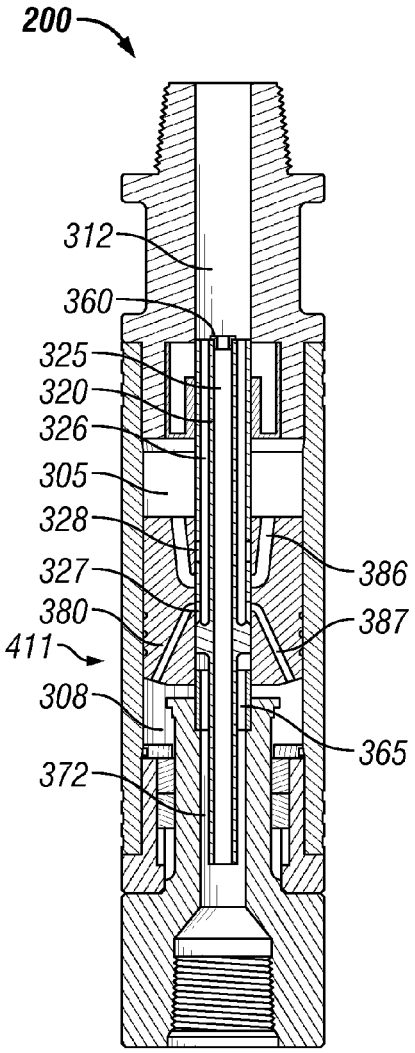
Figures 2, 4C:
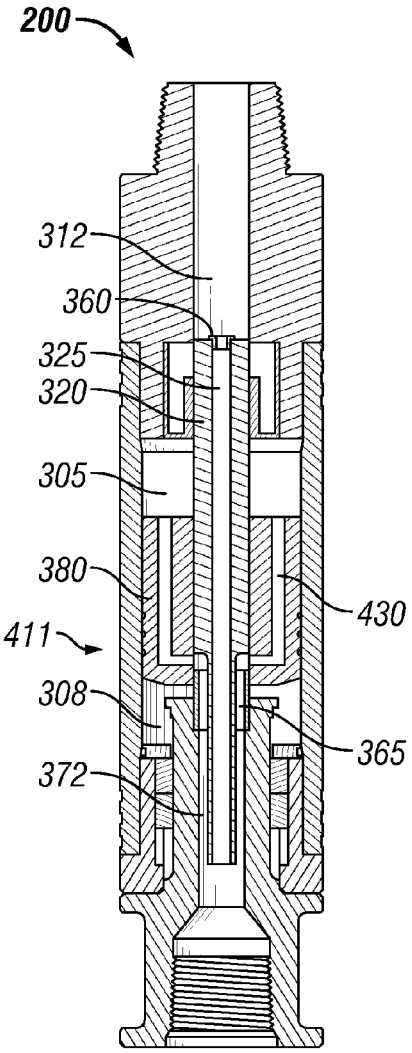

FIG. 4C-1 is a cross-sectional view of the percussion tool 200 with the piston 380 in a first intermediate upward moving position 411 and showing the positioning of the at least one first pressurized fluid conduit 386 and the at least one second pressurized fluid conduit 387 in accordance with an exemplary embodiment of the present invention. FIG. 4C-2 is a cross-sectional view of the percussion tool 200 with the piston 380 in the first intermediate upward moving position 411 and showing the positioning of the at least one top exhaust conduit 430 in accordance with an exemplary embodiment of the present invention. Referring to FIGS. 4C-1 and 4C-2, the piston 380 is positioned in the first intermediate upward moving position 411 and facilitates forming the top pressure fluid chamber 305 above it and the bottom pressure fluid chamber 308 below it. The bottom pressure fluid chamber 308 has increased in volume and the top pressure fluid chamber 305 has decreased in volume when compared to when the piston 380 was in the down position 410 (FIG. 4B-1). At this first intermediate upward moving position 411, the second pressurized fluid conduits 387 within the piston 380 are still in fluid communication with at least one respective first opening 327 of the feed tube 320 and hence still communicates pressurize fluid from the outer feed tube channel 326 to the bottom pressure fluid chamber 308. However, at this first intermediate upward moving position 411, the first pressurized fluid conduits 386 within the piston 380 are not in fluid communication with any of the second openings 328 of the feed tube 320 and hence is not able to communicate pressurize fluid from the outer feed tube channel 326 to the top pressure fluid chamber 305. Thus, only the bottom pressure fluid chamber 308 is filled with pressurized fluid while the top pressure fluid chamber 305 is not, when the piston 380 is at this first intermediate upward moving position 411. As the bottom pressure fluid chamber 308 continues to be filled and the pressure therein increases, the piston 380 continues rising, thereby further decreasing the volume of the top pressure fluid chamber 305 and further increasing the volume of the bottom pressure fluid chamber 308. The pressurized fluid within the bottom pressure fluid chamber 308 still does not exhaust through the exhauster 365 when the piston 380 is at this first intermediate upward moving position 411. As the volume on the top pressure fluid chamber 305 continues to decrease, the fluid therein continues to be exhausted to the outside environment through the at least one top exhaust conduit 430. This fluid proceeds from the top pressure fluid chamber 305, into the at least one top exhaust conduit 430, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). The excess pressurized fluid flowing from the sub passage 312, which is not used for filling the bottom pressure fluid chamber 308, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid still enters only the bottom pressure fluid chamber 308 and therefore is not used to counteract, or work against, itself when being used to move the piston 380.

Figures 1, 4D:
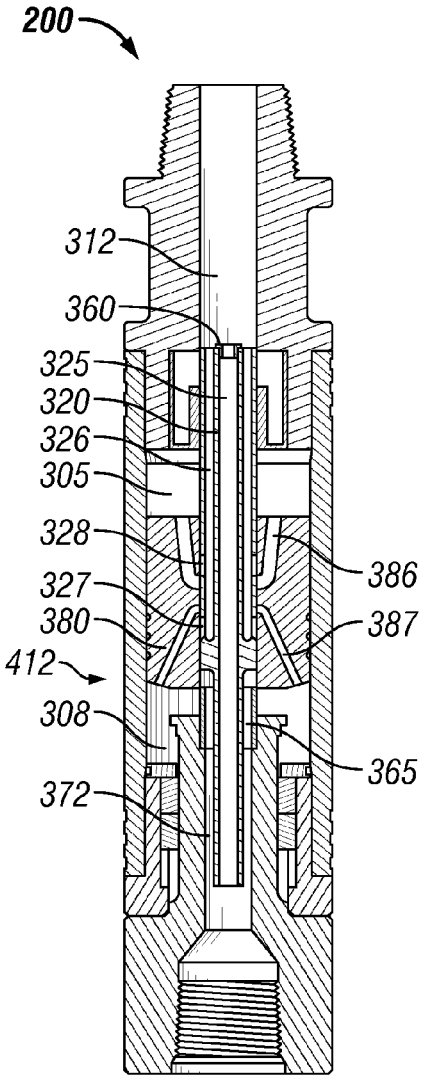
Figures 2, 4D:
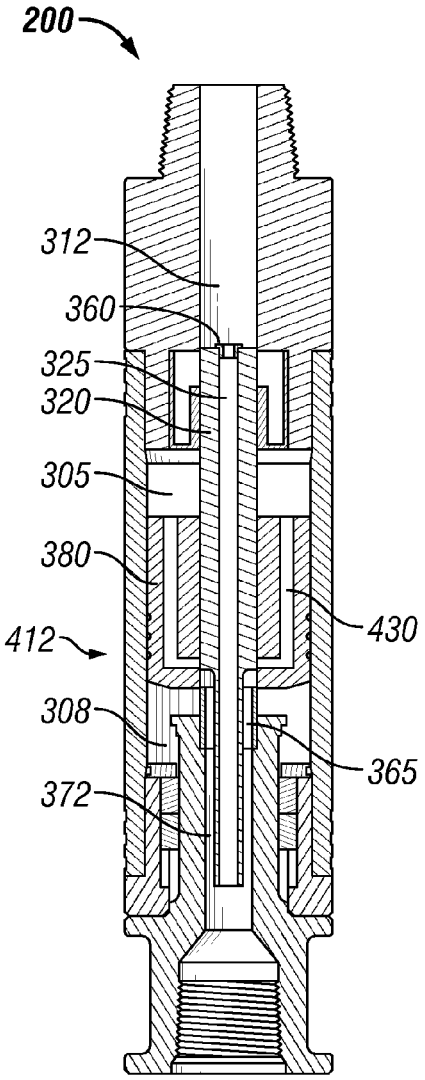

FIG. 4D-1 is a cross-sectional view of the percussion tool 200 with the piston 380 in a second intermediate upward moving position 412 and showing the positioning of the at least one first pressurized fluid conduit 386 and the at least one second pressurized fluid conduit 387 in accordance with an exemplary embodiment of the present invention. FIG. 4D-2 is a cross-sectional view of the percussion tool 200 with the piston 380 in the second intermediate upward moving position 412 and showing the positioning of the at least one top exhaust conduit 430 in accordance with an exemplary embodiment of the present invention. Referring to FIGS. 4D-1 and 4D-2, the piston 380 is positioned in the second intermediate upward moving position 412 and facilitates forming the top pressure fluid chamber 305 above it and the bottom pressure fluid chamber 308 below it. The bottom pressure fluid chamber 308 has further increased in volume and the top pressure fluid chamber 305 has further decreased in volume when compared to when the piston 380 was in the first intermediate upward moving position 411 (FIG. 4C-1). At this second intermediate upward moving position 412, the second pressurized fluid conduits 387 within the piston 380 are no longer in fluid communication with the first openings 327 of the feed tube 320 and hence do not communicate pressurized fluid from the outer feed tube channel 326 to the bottom pressure fluid chamber 308. Similarly, at this second intermediate upward moving position 412, the first pressurized fluid conduits 386 within the piston 380 also are not in fluid communication with any of the second openings 328 of the feed tube 320 and hence are not able to communicate pressurized fluid from the outer feed tube channel 326 to the top pressure fluid chamber 305. Thus, neither the bottom pressure fluid chamber 308 nor the top pressure fluid chamber 305 is filled with pressurized fluid, when the piston 380 is at this second intermediate upward moving position 412. However, the piston 380 continues moving in an upward direction from the forces previously applied to the bottom of the piston. Hence, as the piston 380 continues rising, the volume of the top pressure fluid chamber 305 continues to further decrease, while the volume of the bottom pressure fluid chamber 308 continues to further increase. The pressurized fluid within the bottom pressure fluid chamber 308 still does not exhaust through the exhauster 365 when the piston 380 is at this second intermediate upward moving position 412. Similarly, the fluid within the top pressure fluid chamber 305 no longer continues to exhaust through the exhauster 365 since the top exhaust conduits 430 are not in fluid communication with the exhauster 365. The excess pressurized fluid flowing from the sub passage 312, which is substantially all the pressurized fluid therein, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid does not enter any of the bottom pressure fluid chamber 308 or the top pressure fluid chamber 305, and therefore is not used to counteract, or work against, itself when being used to move the piston 380.

Figures 1, 4E:
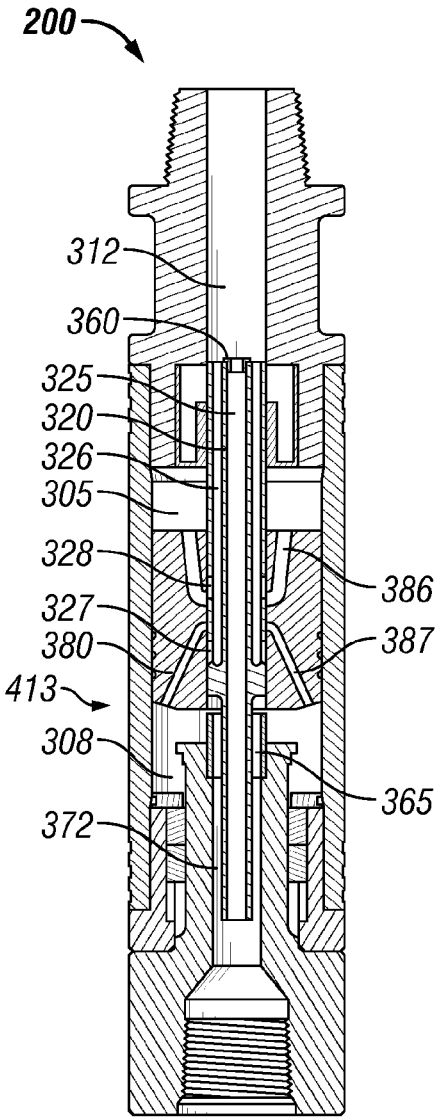
Figures 2, 4E:
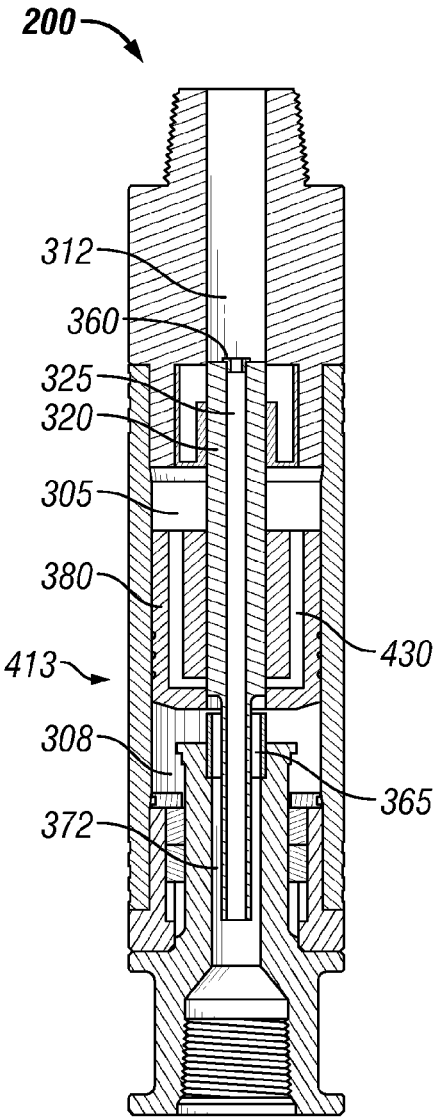

FIG. 4E-1 is a cross-sectional view of the percussion tool 200 with the piston 380 in a third intermediate upward moving position 413 and showing the positioning of the at least one first pressurized fluid conduit 386 and the at least one second pressurized fluid conduit 387 in accordance with an exemplary embodiment of the present invention. FIG. 4E-2 is a cross-sectional view of the percussion tool 200 with the piston 380 in the third intermediate upward moving position 413 and showing the positioning of the at least one top exhaust conduit 430 in accordance with an exemplary embodiment of the present invention. Referring to FIGS. 4E-1 and 4E-2, the piston 380 is positioned in the third intermediate upward moving position 413 and facilitates forming the top pressure fluid chamber 305 above it and the bottom pressure fluid chamber 308 below it. The bottom pressure fluid chamber 308 has increased in volume and the top pressure fluid chamber 305 has decreased in volume when compared to when the piston 380 was in the second intermediate upward moving position 412 (FIG. 4D-1). At this third intermediate upward moving position 413, the first pressurized fluid conduits 386 within the piston 380 are now in fluid communication with at least one respective second opening 328 of the feed tube 320 and hence communicates pressurized fluid from the outer feed tube channel 326 to the top pressure fluid chamber 305. However, at this third intermediate upward moving position 413, the second pressurized fluid conduits 387 within the piston 380 are not in fluid communication with any of the first openings 327 of the feed tube 320 and hence are not able to communicate pressurized fluid from the outer feed tube channel 326 to the bottom pressure fluid chamber 308. Thus, now only the top pressure fluid chamber 305 is filled with pressurized fluid while the bottom pressure fluid chamber 308 is not, when the piston 380 is at this third intermediate upward moving position 413. As the top pressure fluid chamber 305 is now filled with pressurized fluid and the pressure therein increases, the piston 380 continues rising but starts slowing down, thereby further decreasing the volume of the top pressure fluid chamber 305 and further increasing the volume of the bottom pressure fluid chamber 308. The pressurized fluid within the bottom pressure fluid chamber 308 now exhausts through the exhauster 365 when the piston 380 is at this third intermediate upward moving position 413. This fluid proceeds from the bottom pressure fluid chamber 308, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). As the volume in the top pressure fluid chamber 305 continues to decrease, the fluid therein is pressurized more since the fluid therein is not exhausted through the exhauster 365. The at least one top exhaust conduit 430 is no longer fluidly communicable with the exhauster 365. This pressurized fluid within the top pressure fluid chamber 305 causes the piston 380 to slow down in its upward movement. The excess pressurized fluid flowing from the sub passage 312, which is not used for filling the top pressure fluid chamber 305, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid now enters only the top pressure fluid chamber 305 and therefore is not used to counteract, or work against, itself when being used to slow the movement of the piston 380.

Figures 1, 4F:
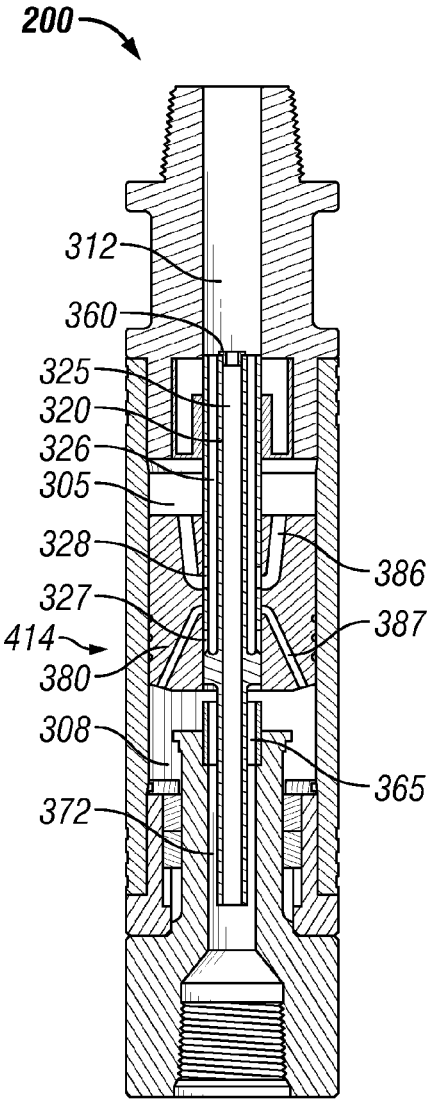
Figures 2, 4F:
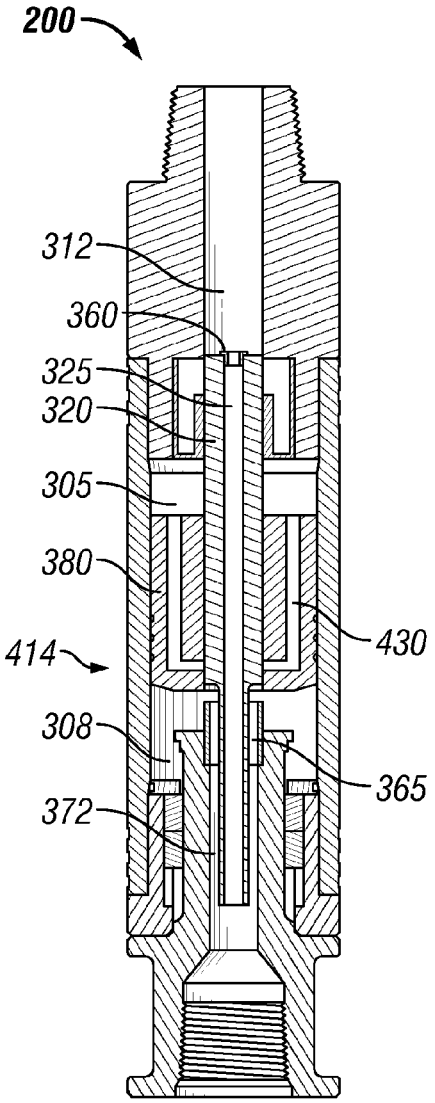

FIG. 4F-1 is a cross-sectional view of the percussion tool 200 with the piston 380 in an up position 414 and showing the positioning of the at least one first pressurized fluid conduit 386 and the at least one second pressurized fluid conduit 387 in accordance with an exemplary embodiment of the present invention. FIG. 4F-2 is a cross-sectional view of the percussion tool 200 with the piston 380 in the up position 414 and showing the positioning of the at least one top exhaust conduit 430 in accordance with an exemplary embodiment of the present invention. Referring to FIGS. 4F-1 and 4F-2, the piston 380 is positioned in the up position 414 and facilitates forming the top pressure fluid chamber 305 above it and the bottom pressure fluid chamber 308 below it. The bottom pressure fluid chamber 308 has increased in volume and the top pressure fluid chamber 305 has decreased in volume when compared to when the piston 380 was in the third intermediate upward moving position 413 (FIG. 4E-1). At this up position 414, the first pressurized fluid conduits 386 within the piston 380 are still in fluid communication with at least one respective second opening 328 of the feed tube 320 and hence communicates pressurized fluid from the outer feed tube channel 326 to the top pressure fluid chamber 305. However, at this up position 414, the second pressurized fluid conduits 387 within the piston 380 are not in fluid communication with any of the first openings 327 of the feed tube 320 and hence are not able to communicate pressurized fluid from the outer feed tube channel 326 to the bottom pressure fluid chamber 308. Thus, now only the top pressure fluid chamber 305 is filled with pressurized fluid while the bottom pressure fluid chamber 308 is not, when the piston 380 is at this up position 414. At this up position 414, the piston 380 is at its highest elevational position and the top pressure fluid chamber 305 is at its smallest volume. As the top pressure fluid chamber 305 continues to be filled with pressurized fluid and the pressure therein increases, the piston 380 will start falling, thereby eventually increasing the volume of the top pressure fluid chamber 305 and decreasing the volume of the bottom pressure fluid chamber 308. The pressurized fluid within the bottom pressure fluid chamber 308 continues to be exhausted through the exhauster 365 when the piston 380 is at this up position 414. This fluid proceeds from the bottom pressure fluid chamber 308, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). As the volume in the top pressure fluid chamber 305 is relatively constant, the fluid therein is pressurized more as more pressurized fluid enters the top pressure fluid chamber 305 and since the fluid therein is not exhausted through the exhauster 365. The at least one top exhaust conduit 430 is still not fluidly communicable with the exhauster 365. This pressurized fluid within the top pressure fluid chamber 305 causes the piston 380 to stop its upward movement. The excess pressurized fluid flowing from the sub passage 312, which is not used for filling the top pressure fluid chamber 305, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid now enters only the top pressure fluid chamber 305 and therefore is not used to counteract, or work against, itself when being used to stop the movement of the piston 380.

Figures 1, 4G:
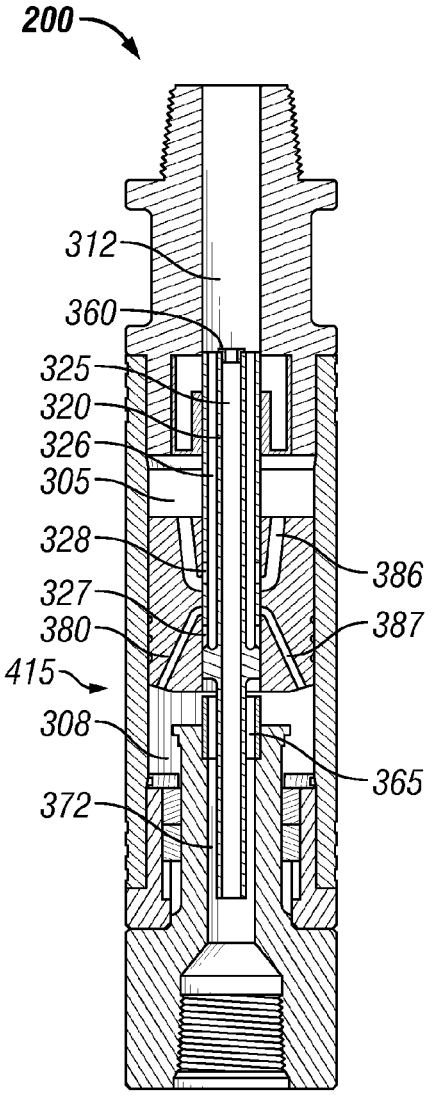
Figures 2, 4G:
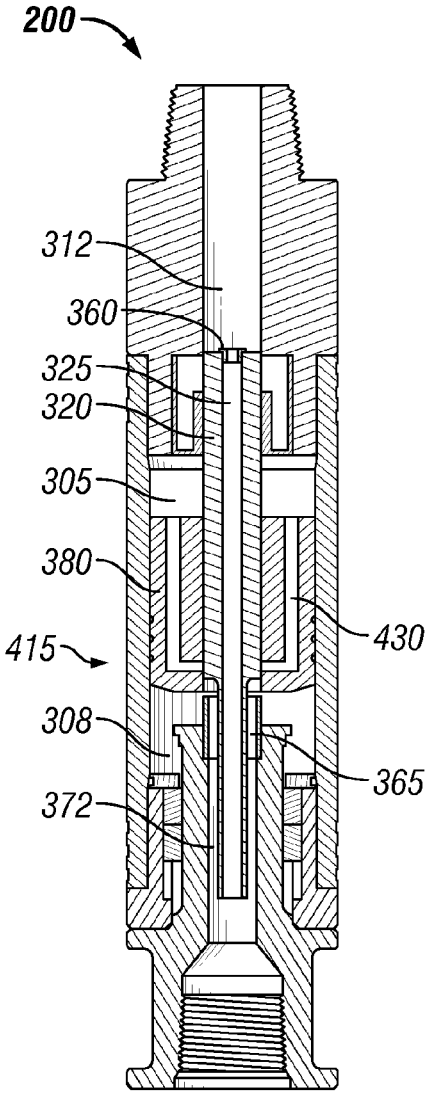

FIG. 4G-1 is a cross-sectional view of the percussion tool 200 with the piston 380 in a first intermediate downward moving position 415 and showing the positioning of the at least one first pressurized fluid conduit 386 and the at least one second pressurized fluid conduit 387 in accordance with an exemplary embodiment of the present invention. FIG. 4G-2 is a cross-sectional view of the percussion tool 200 with the piston 380 in the first intermediate downward moving position 415 and showing the positioning of the at least one top exhaust conduit 430 in accordance with an exemplary embodiment of the present invention. Referring to FIGS. 4G-1 and 4G-2, the piston 380 is positioned in the first intermediate downward moving position 415 and facilitates forming the top pressure fluid chamber 305 above it and the bottom pressure fluid chamber 308 below it. The bottom pressure fluid chamber 308 has decreased in volume and the top pressure fluid chamber 305 has increased in volume when compared to when the piston 380 was in the up position 414 (FIG. 4F-1). At this first intermediate downward moving position 415, the first pressurized fluid conduits 386 within the piston 380 are still in fluid communication with at least one respective second opening 328 of the feed tube 320 and hence continue to communicate pressurized fluid from the outer feed tube channel 326 to the top pressure fluid chamber 305. However, at this first intermediate downward moving position 415, the second pressurized fluid conduits 387 within the piston 380 are still not in fluid communication with any of the first openings 327 of the feed tube 320 and hence still does not communicate pressurized fluid from the outer feed tube channel 326 to the bottom pressure fluid chamber 308. Thus, only the top pressure fluid chamber 305 is filled with pressurized fluid while the bottom pressure fluid chamber 308 is not, when the piston 380 is at this first intermediate downward moving position 415. As the top pressure fluid chamber 305 continues to be filled and the pressure therein increases, the piston 380 continues falling, thereby further decreasing the volume of the bottom pressure fluid chamber 308 and further increasing the volume of the top pressure fluid chamber 305. The pressurized fluid within the top pressure fluid chamber 305 still does not exhaust through the exhauster 365 when the piston 380 is at this first intermediate downward moving position 415. As the volume in the bottom pressure fluid chamber 308 continues to decrease, the fluid therein continues to be exhausted to the outside environment through the exhauster 365 when the piston 380 is at this first intermediate downward moving position 415. This fluid proceeds from the bottom pressure fluid chamber 308, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). As the pressurized fluid enters the top pressure fluid chamber 305 and the pressurized fluid within the top pressure fluid chamber 305 is not exhausted, the fluid therein forces the piston 380 to move further downward. The at least one top exhaust conduit 430 is still not fluidly communicable with the exhauster 365. The excess pressurized fluid flowing from the sub passage 312, which is not used for filling the top pressure fluid chamber 305, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid still enters only the top pressure fluid chamber 305 and therefore is not used to counteract, or work against, itself when being used to move the piston 380.

Figures 1, 4H:
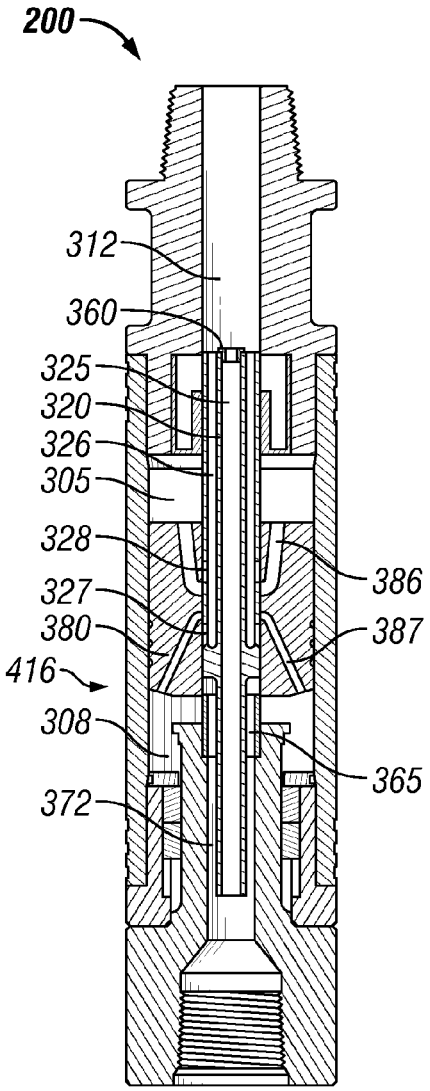
Figures 2, 4H:
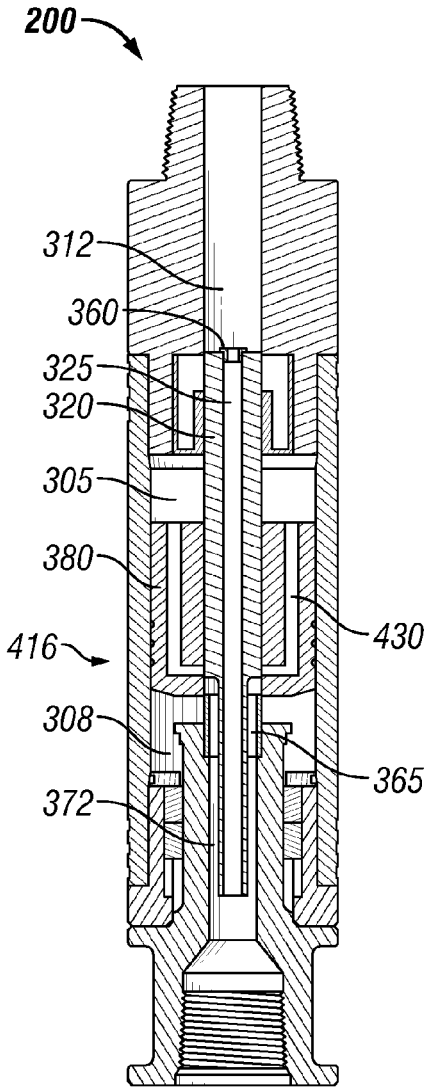

FIG. 4H-1 is a cross-sectional view of the percussion tool 200 with the piston 380 in a second intermediate downward moving position 416 and showing the positioning of the at least one first pressurized fluid conduit 386 and the at least one second pressurized fluid conduit 387 in accordance with an exemplary embodiment of the present invention. FIG. 4H-2 is a cross-sectional view of the percussion tool 200 with the piston 380 in the second intermediate downward moving position 416 and showing the positioning of the at least one top exhaust conduit 430 in accordance with an exemplary embodiment of the present invention. Referring to FIGS. 4H-1 and 4H-2, the piston 380 is positioned in the second intermediate downward moving position 416 and facilitates forming the top pressure fluid chamber 305 above it and the bottom pressure fluid chamber 308 below it. The top pressure fluid chamber 305 has further increased in volume and the bottom pressure fluid chamber 308 has further decreased in volume when compared to when the piston 380 was in the first intermediate downward moving position 415 (FIG. 4G-1). At this second intermediate downward moving position 416, the first pressurized fluid conduits 386 within the piston 380 are no longer in fluid communication with the second openings 328 of the feed tube 320 and hence do not communicate pressurized fluid from the outer feed tube channel 326 to the top pressure fluid chamber 305. Similarly, at this second intermediate downward moving position 416, the second pressurized fluid conduits 387 within the piston 380 also are not in fluid communication with any of the first openings 327 of the feed tube 320 and hence are not able to communicate pressurized fluid from the outer feed tube channel 326 to the bottom pressure fluid chamber 308. Thus, neither the top pressure fluid chamber 305 nor the bottom pressure fluid chamber 308 is filled with pressurized fluid, when the piston 380 is at this second intermediate downward moving position 416. However, the piston 380 continues moving in a downward direction from the forces previously applied to the top of the piston 380. Hence, as the piston 380 continues falling, the volume of the bottom pressure fluid chamber 308 continues to further decrease, while the volume of the top pressure fluid chamber 305 continues to further increase. The pressurized fluid within the top pressure fluid chamber 305 still does not exhaust through the exhauster 365 when the piston 380 is at this second intermediate downward moving position 416 since the top exhaust conduits 430 are not in fluid communication with the exhauster 365. Similarly, the fluid within the bottom pressure fluid chamber 308 no longer continues to exhaust through the exhauster 365 since the bottom pressure fluid chamber 308 is not in fluid communication with the exhauster 365. The excess pressurized fluid flowing from the sub passage 312, which is substantially all the pressurized fluid therein, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid does not enter any of the top pressure fluid chamber 305 or the bottom pressure fluid chamber 308, and therefore is not used to counteract, or work against, itself when being used to move the piston 380.

Figures 1, 4I:
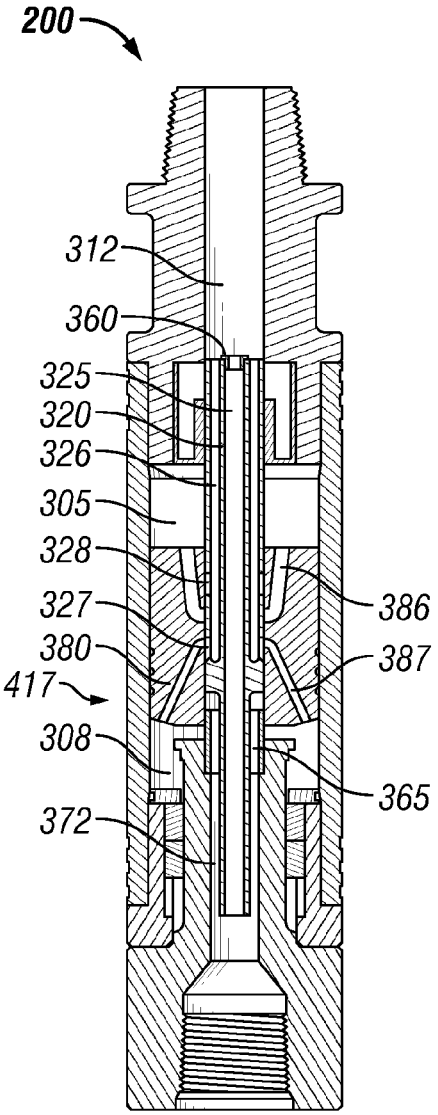
Figures 2, 4I:
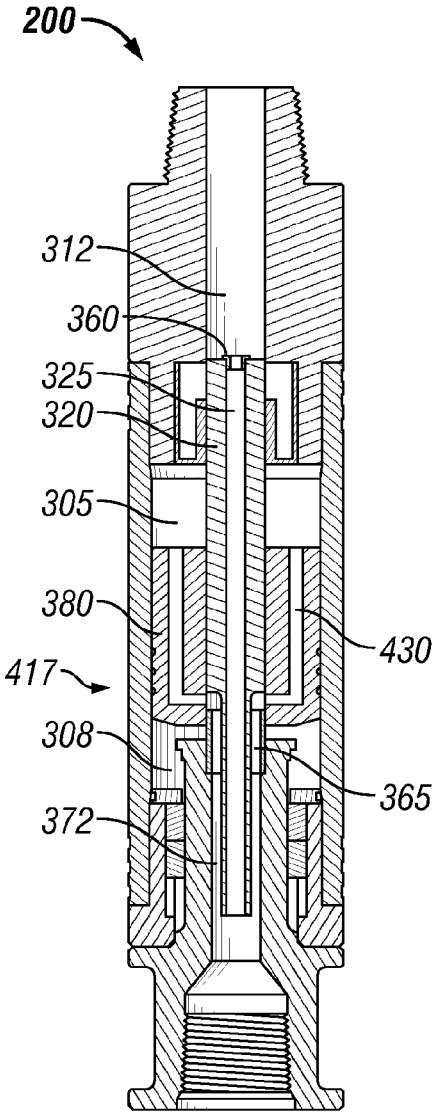

FIG. 4I-1 is a cross-sectional view of the percussion tool 200 with the piston 380 in a third intermediate downward moving position 417 and showing the positioning of the at least one first pressurized fluid conduit 386 and the at least one second pressurized fluid conduit 387 in accordance with an exemplary embodiment of the present invention. FIG. 4I-2 is a cross-sectional view of the percussion tool 200 with the piston 380 in the third intermediate downward moving position 417 and showing the positioning of the at least one top exhaust conduit 430 in accordance with an exemplary embodiment of the present invention. Referring to FIGS. 4I-1 and 4I-2, the piston 380 is positioned in the third intermediate downward moving position 417 and facilitates forming the top pressure fluid chamber 305 above it and the bottom pressure fluid chamber 308 below it. The top pressure fluid chamber 305 has increased in volume and the bottom pressure fluid chamber 308 has decreased in volume when compared to when the piston 380 was in the second intermediate downward moving position 416 (FIG. 4H-1). At this third intermediate downward moving position 417, the second pressurized fluid conduits 387 within the piston 380 are now in fluid communication with at least one respective first opening 327 of the feed tube 320 and hence communicates pressurized fluid from the outer feed tube channel 326 to the bottom pressure fluid chamber 308. However, at this third intermediate downward moving position 417, the first pressurized fluid conduits 386 within the piston 380 are not in fluid communication with any of the second openings 328 of the feed tube 320 and hence are not able to communicate pressurized fluid from the outer feed tube channel 326 to the top pressure fluid chamber 305. Thus, now only the bottom pressure fluid chamber 308 is filled with pressurized fluid while the top pressure fluid chamber 305 is not, when the piston 380 is at this third intermediate downward moving position 417. As the bottom pressure fluid chamber 308 is now filled with pressurized fluid and the pressure therein increases, the piston 380 continues falling but starts slowing down, thereby further decreasing the volume of the bottom pressure fluid chamber 308 and further increasing the volume of the top pressure fluid chamber 305. The pressurized fluid within the top pressure fluid chamber 305 now exhausts through the exhauster 365 when the piston 380 is at this third intermediate downward moving position 417. This fluid proceeds from the top pressure fluid chamber 305, through the at least one top exhaust conduit 430, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). As the volume in the bottom pressure fluid chamber 308 continues to decrease, the fluid therein is pressurized more since the fluid therein is not exhausted through the exhauster 365. The bottom pressure fluid chamber 308 is no longer fluidly communicable with the exhauster 365. This pressurized fluid within the bottom pressure fluid chamber 308 causes the piston 380 to slow down in its downward movement. The excess pressurized fluid flowing from the sub passage 312, which is not used for filling the bottom pressure fluid chamber 308, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid now enters only the bottom pressure fluid chamber 308 and therefore is not used to counteract, or work against, itself when being used to slow the movement of the piston 380.

Figures 1, 4J:
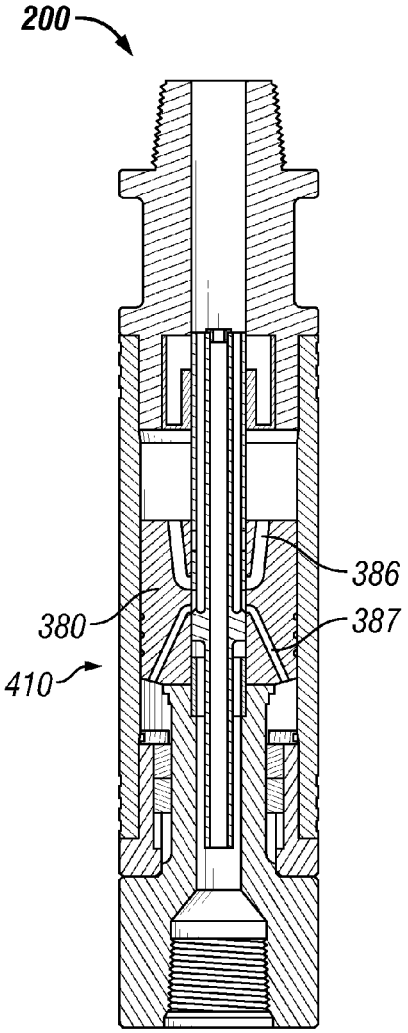
Figures 2, 4J:
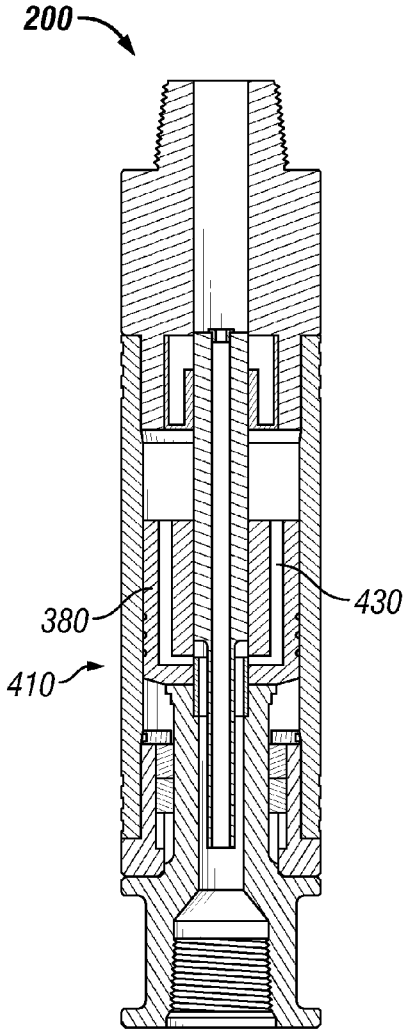

FIG. 4J-1 is a cross-sectional view of the percussion tool 200 with the piston 380 in the down position 410 and showing the positioning of the at least one first pressurized fluid conduit 386 and the at least one second pressurized fluid conduit 387 in accordance with an exemplary embodiment of the present invention. FIG. 4J-2 is a cross-sectional view of the percussion tool 200 with the piston 380 in the down position 410 and showing the positioning of the at least one top exhaust conduit 430 in accordance with an exemplary embodiment of the present invention. FIGS. 4J-1 and 4J-2 illustrate the piston 380 in the same position as illustrated in FIGS. 4B-1 and 4B-2 since the piston 380 has completed one movement cycle. Since FIGS. 4J-1 and 4J-2 illustrate the piston 380 in the same position as illustrated in FIGS. 4B-1 and 4B-2, the description previously provided with respect to FIGS. 4B-1 and 4B-2 also applies to the description of FIGS. 4J-1 and 4J-2; and therefore is not repeated again herein for the sake of brevity.

Although a few exemplary embodiments have been described and/or illustrated with respect to the components used in fabricating the percussion tool 200 and with respect to the operation of the percussion tool 200, modifications made with respect to these components and/or how the percussion tool 200 operates are envisioned to be included within the exemplary embodiments of this invention. For example, as previously mentioned, the check valve 302 may be placed upstream of the choke 360 or downstream of the choke 360, such as within the bit 290. Other types of modifications may be made such as reducing the number of components or increasing the number of components. Further, the connection type between the components may be altered without departing from the scope and spirit of the exemplary embodiments. Further, although the exemplary embodiments has been illustrated using a roller cone bit being coupled to the mandrel 270, other types of bits may be coupled to the mandrel 270, such as fixed cutter bits and hammers. Alternatively, these bits may be integrally formed with the mandrel 270 without departing from the scope and spirit of the exemplary embodiments.

Figure 5:
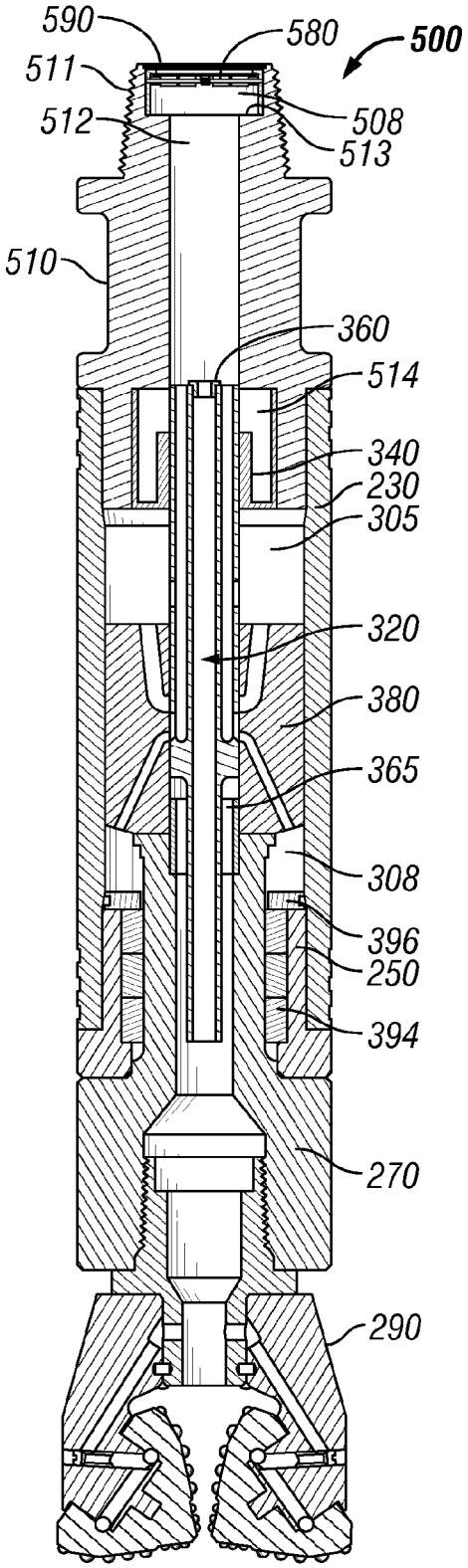
FIG. 5 is a cross-sectional view of a percussion tool in accordance with another exemplary embodiment of the present invention.

FIG. 5 is a cross-sectional view of a percussion tool 500 in accordance with another exemplary embodiment of the present invention. Referring to FIG. 5, the percussion tool 500 includes a top sub 510, a case 230, a drive sub 250, a mandrel 270, and a bit 290, which are viewable and accessible from exterior of the percussion tool 500. The percussion tool 500 further includes a feed tube 320, a feed tube mount 340, a choke 360, a piston 380, one or more drive lugs 394, an exhauster 365, a split retaining ring 396, a check valve 580, and a retaining ring 590, which are all positioned internally of the percussion tool 500. Although certain components have been mentioned, greater or fewer components may be included in the percussion tool 500 without departing from the scope and spirit of the exemplary embodiment. Further, one or more components may be combined or separated from another mentioned component without departing from the scope and spirit of the exemplary embodiment. Once the percussion tool 500 is assembled, a top pressure fluid chamber 305 and a bottom pressure fluid chamber 308 are formed.

Each of the case 230, the drive sub 250, the mandrel 270, the bit 290, the feed tube 320, the feed tube mount 340, the choke 360, the piston 380, the one or more drive lugs 394, the exhauster 365, the split retaining ring 396, the top pressure fluid chamber 305, and the bottom pressure fluid chamber 308 have been previously described. For the sake of brevity, these components are not described again herein.

Top sub 510 is similar to top sub 210 (FIG. 3) except that top sub 510 forms a first sub passage 508, a second sub passage 512, and a third sub passage 514 collectively extending therethrough. The first sub passage 508 is formed at a top end 511 of the top sub 510 and extends downwardly to the second sub passage 512. The first sub passage 508 is fluidly communicable with the second sub passage 512. The first sub passage 508 is larger in diameter than the second sub passage 512. The first sub passage 508 houses the check valve 580 and the retaining ring 590 therein according to certain exemplary embodiments. The first sub passage 508 is dimensioned to receive the check valve 580 and the retaining ring 590 in a secure manner. The second sub passage 512 is similar to sub passage 312 (FIG. 3) except that the second sub passage 512 extends from an end of the first sub passage 508 instead of from the top end 511 of the top sub 510, which is similar to the top end 312 (FIG. 3). Since the second sub passage 512 is similar to the sub passage 312 (FIG. 3), the details are not repeated herein for the sake of brevity. Further, the third sub passage 314 is fluidly communicable with the second sub passage 512. Since, the third sub passage 314 is similar to the secondary sub passage 314 (FIG. 3), it is therefore not described again in detail for the sake of brevity.

Figure 6A:
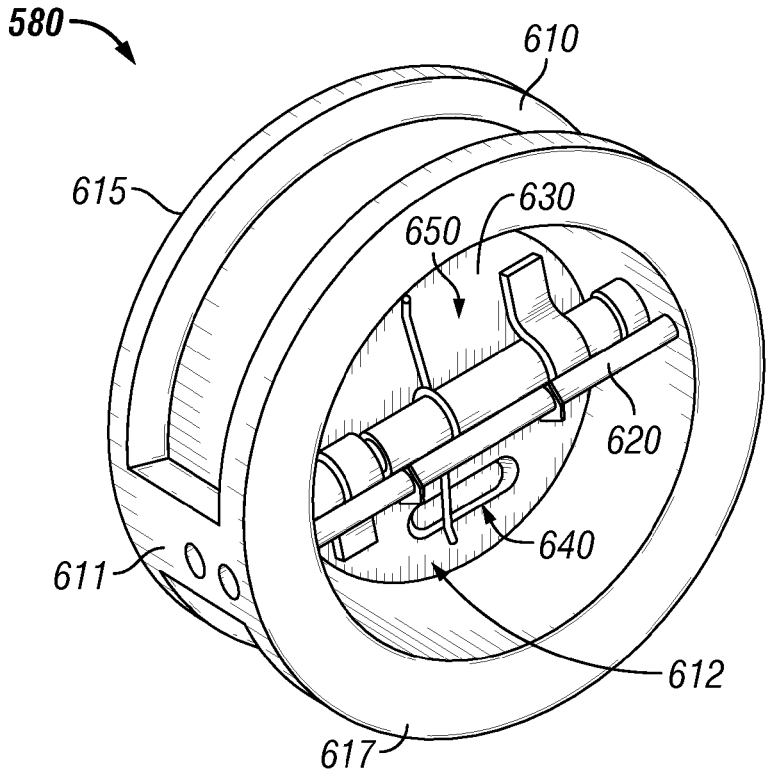
FIG. 6 A is a perspective view of a check valve used in the percussion tool of FIG. 5 in accordance with another exemplary embodiment of the present invention.
FIG. 6B is a cross-sectional view of the check valve of FIG. 6A in accordance with another exemplary embodiment of the present invention.
Figure 6B:
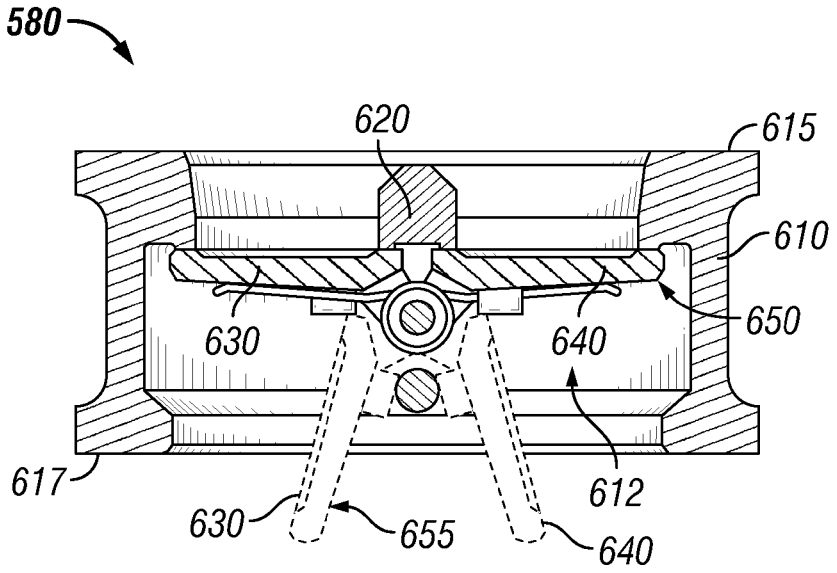

FIG. 6 A is a perspective view of the check valve 580 used in the percussion tool 500 in accordance with another exemplary embodiment of the present invention. FIG. 6B is a cross-sectional view of the check valve 580 in accordance with that exemplary embodiment of the present invention. Referring to FIGS. 5-6B, the check valve 580 is a butterfly valve that includes a housing 610, a spring clip 620, a first flap 630, and a second flap 640. The housing 610 is annularly shaped and forms a valve passageway 612 extending therethrough. The valve passageway 612 has a circular cross-section according to some exemplary embodiments. However, in other exemplary embodiments, the housing 610 and/or the valve passageway 612 have a different shape without departing from the scope and spirit of the exemplary embodiment. The outer surface 611 of the housing 610 is slightly smaller than the dimension of the first sub passage 508 such that the housing 610 is positioned securely within the first sub passage 508. According to some exemplary embodiments, the housing 610 is in contact with a platform 513 formed where the first sub passage 508 transitions into the second sub passage 512.

The spring clip 620 extends latitudinally across the diameter of the valve passageway 612. The first flap 630 extends outwardly from the spring clip 620 within the valve passageway 612 such that the first flap 630 occupies about half the cross-sectional area defined by the valve passageway when in a closed position 650, or biased position. Similarly, the second flap 640 extends outwardly from the spring clip 620 within the valve passageway 612 in an opposite direction than the first flap 630 when in a closed position 650, or biased position. The second flap 640 occupies about the remaining half of the cross-sectional area defined by the valve passageway 612. Hence, the spring clip 620, the first flap 630, and the second flap 640 collectively occupy substantially the cross-sectional area defined by the valve passageway 612, when the first flap 630 and the second flap 640 are in a closed position 650, or biased position. The first flap 630 and the second flap 640 are moveable from the closed position 650 to an open position 655 when air, or some other fluid, flows from a top end 615 of the housing 610 towards a bottom end 617 of the housing 610. The open position 655 is illustrated in FIG. 6B when the first flap 630 and the second flap 640 are in the dashed orientation. The spring clip 620 facilitates biasing the first flap 630 and the second flap 640 into the closed position 650 and allows for these flaps 630, 640 to open when air, or some other fluid flows from the top end 615 to the bottom end 617. According to some exemplary embodiments, the check valve 580 is placed into proper position, however, according to other exemplary embodiments, the check valve 580 may be threadedly coupled to the interior of the first sub passage 508 near the top end 511 of the top sub 510 or coupled according to any other method known to people having ordinary skill in the art.

The retaining ring 590 is a snap ring according to some exemplary embodiments and is configured to be positioned immediately adjacent the top end 615 of the housing 610. The retaining ring 590 is positioned at the top end 511 of the top sub 510 and prevents the check valve 580 from moving about unintentionally. According to some exemplary embodiments, the retaining ring 590 snaps into position, however, according to other exemplary embodiments, the retaining ring 590 may be threadedly couple to the interior of the first sub passage 508 at the top end 511 of the top sub 510 or coupled according to any other method known to people having ordinary skill in the art.

When the check valve 580 is positioned upstream of the choke 360, as illustrated in FIG. 5, the check valve 580 is easily removable such that maintenance or replacement of the choke 360 is able to be performed without dismantling, or disassembling, the percussion tool 500. For example, the retaining ring 590 is removed from the top end 511 of the top sub 510 via unthreading or unsnapping the retaining ring 590. The check valve 580 is then removed via removing or unthreading the check valve 580. Access to the choke 360 is now possible using a tool (not shown), such a rod with one or more features at its end. The tool is used to provide maintenance to the choke 360. In other exemplary embodiments, the tool is used to threadedly remove the choke 360 and replace the choke 360 with a different choke 360, of the same type or of a different type, such as a choke with a different diameter opening.

Figure 7A:
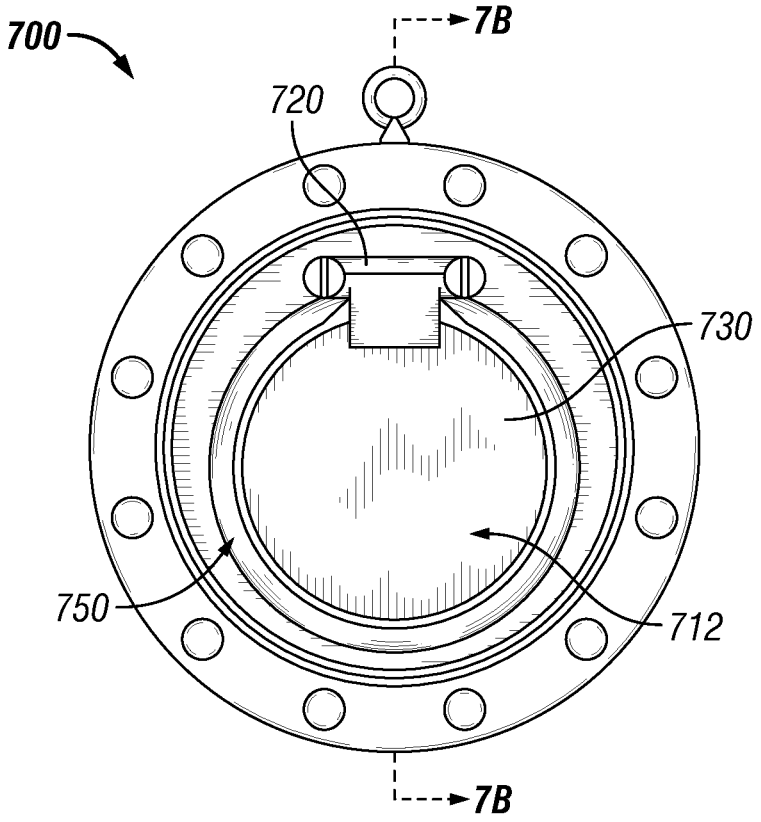
FIG. 7A is a bottom view of a check valve useable in the percussion tool of FIG. 5 in lieu of the check valve of FIGS. 6A and 6B, in accordance to yet another exemplary embodiment.
Figure 7B:
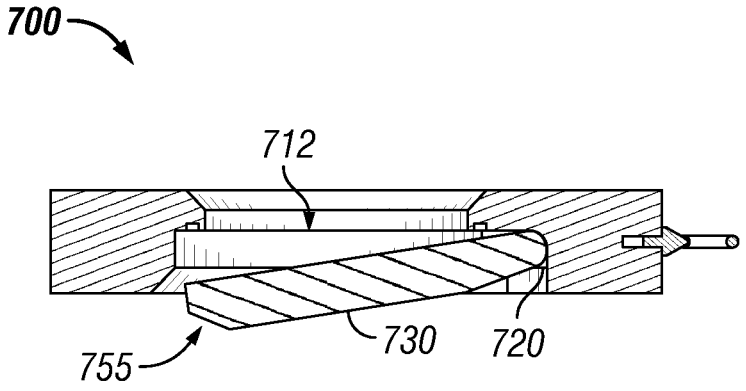
FIG. 7B is a cross-sectional view of the check valve of FIG. 7A in accordance with that exemplary embodiment of the present invention.

FIG. 7A is a bottom view of a check valve 700 useable in the percussion tool 500 (FIG. 5) in lieu of the check valve 580 (FIGS. 5-6B) in accordance to yet another exemplary embodiment. FIG. 7B is a cross-sectional view of the check valve 700 in accordance with that exemplary embodiment of the present invention. The check valve 700 is similar to check valve 580 (FIGS. 5-6B), except that check valve 700 includes a spring clip 720 and a single flap 730. The spring clip 720 is similar to spring clip 620 (FIGS. 6A and 6B), except that the spring clip 720 is positioned near a perimeter of a valve passageway 712, which is similar to the valve passageway 612 (FIGS. 6A and 6B). The spring clip 720 is configured to bias the single flap 730 in a closed position 750. The single flap 730 is moveable from a closed position 750 to an open position 755 and back again in a similar manner that that the first flap 630 (FIGS. 6A and 6B) and the second flap 640 (FIGS. 6A and 6B) are moved. The single flap 730 is moveable into an even more open position 755 than illustrated in FIG. 7B. Hence, the check valve 580, 700 can have one or more flaps, including more than two flaps, if desired. Further, the check valve 700 operates in a similar manner as check valve 580 (FIGS. 5-6B) and is removable in a similar manner as check valve 580 (FIGS. 5-6B) such that maintenance or replacement of the choke 360 is able to be performed without dismantling, or disassembling, the percussion tool 500.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A downhole percussion tool, comprising:

a casing comprising a top end, a bottom end, and a casing passageway extending longitudinally from the top end to the bottom end;

a top sub comprising a top sub passageway extending longitudinally therethrough and coupled to the top end of the casing;

a drive sub coupled to the bottom end of the casing;

a mandrel comprising a mandrel passageway extending longitudinally therethrough, the mandrel being supported within a lower portion of the casing and extending through the drive sub;

a feed tube disposed within the casing passageway and comprising an inner wall defining a central channel extending the length of the feed tube, the central channel in fluid communication with the top sub passageway and the mandrel passageway;

a choke coupled to a top end of the feed tube and comprising a choke passageway restricting the flow of a fluid from the top sub passageway through the central channel; and a check valve positioned in fluid communication with the choke, wherein the choke is accessible from the top sub through the top sub passageway without dismantling the top sub from the casing.

2. The downhole percussion tool of claim 1, further comprising a bit coupled to the mandrel and extending outwardly from a bottom portion of the mandrel.

3. The downhole percussion tool of claim 1, further comprising a bit integrally formed with the mandrel.

4. The downhole percussion tool of claim 1, wherein the feed tube further comprises an outer wall surrounding at least a portion of the length of the inner wall from the top end of the feed tube, the outer wall and the inner wall defining an outer channel therebetween, the outer channel extending from the top end of the feed tube to a portion of the length of the feed tube, the outer wall comprising at least one opening therein.

5. The downhole percussion tool of claim 4, further comprising a piston slidably mounted within the casing passageway above the mandrel and moveable to deliver an impact force onto the mandrel, the piston comprising:

an interior wall extending from an upper surface of the piston to a lower surface of the piston and defining a piston passageway extending therethrough, the piston passageway receiving a portion of the feed tube, the interior wall of the piston and the outer wall of the feed tube being positioned in close fitting relationship;

an exterior wall surrounding the interior wall and extending from the upper surface of the piston to the lower surface of the piston, the exterior wall and the casing being positioned in close fitting relationship;

a first conduit extending from the interior wall of the piston to the upper surface of the piston, the first conduit being in fluid communication with the at least one opening when the piston is at an up position;

a second conduit extending from the interior wall of the piston to the lower surface of the piston, the second conduit being in fluid communication with the at least one opening when the piston is at a down position;

wherein a portion of the casing passageway forms an upper chamber positioned adjacently above the piston and in fluid communication with the first conduit and forms a lower chamber positioned adjacently below the piston and in fluid communication with the second conduit.

6. The downhole percussion tool of claim 5, wherein the at least one opening comprises a plurality of first openings and a plurality of second openings, the plurality of first openings being in fluid communication with the second conduit when the piston is at the down position and the plurality of second openings being in fluid communication with the first conduit when the piston is at the up position.

7. The downhole percussion tool of claim 6, wherein the plurality of first openings are positioned elevationally above the plurality of second openings.

8. The downhole percussion tool of claim 6, wherein the plurality of first openings are radially aligned.

9. The downhole percussion tool of claim 6, wherein the plurality of second openings are radially aligned.

10. The downhole percussion tool of claim 5, wherein the second conduit is positioned entirely below the first conduit.

11. The downhole percussion tool of claim 5, wherein the at least one opening comprises a plurality of first openings and a plurality of second openings, the plurality of first openings being in fluid communication with the second conduit when the piston is at one or more first intermediate positions, the one or more first intermediate positions being near the down position and the plurality of second openings being in fluid communication with the first conduit when the piston is at one or more second intermediate positions, the one or more second intermediate positions being near the up position.

12. The downhole percussion tool of claim 5, wherein the piston further comprises at least one exhaust conduit extending from the upper surface of the piston to a lower portion of the interior surface of the piston, the at least one exhaust conduit exhausting fluid from the upper chamber when the piston is at or near the down position.

13. The downhole percussion tool of claim 5, wherein the at least one opening is fluidly coupled with only one of the first conduit or the second conduit.

14. The downhole percussion tool of claim 1, wherein the check valve is positioned downstream of the choke.

15. The downhole percussion tool of claim 14, wherein the choke is replaceable without dismantling the downhole percussion tool.

16. The downhole percussion tool of claim 1, wherein the check valve is positioned upstream of the choke.

17. A downhole percussion tool, comprising:

a casing comprising a top end, a bottom end, and a casing passageway extending longitudinally from the top end to the bottom end;

a top sub comprising a top sub passageway extending longitudinally therethrough and coupled to the top end of the casing;

a drive sub coupled to the bottom end of the casing;

a mandrel comprising a mandrel passageway extending longitudinally therethrough, the mandrel being supported within a lower portion of the casing;

a feed tube disposed within the casing passageway and comprising an inner wall and an outer wall surrounding at least a portion of the length of the inner wall from a top end of the feed tube, the inner wall defining a central channel extending the length of the feed tube, the central channel in fluid communication with the top sub passageway and the mandrel passageway, the outer wall and the inner wall defining an outer channel therebetween, the outer channel extending from the top end of the feed tube to a portion of the length of the feed tube, the outer wall comprising at least one opening therein;

a choke coupled to a top end of the feed tube and comprising a choke passageway regulating the flow of a fluid from the top sub passageway through the central channel;

a check valve positioned in fluid communication with the choke; and a bit coupled to the mandrel and extending outwardly from a bottom portion of the mandrel, wherein the choke is accessible from the top sub through the top sub passageway without dismantling the top sub from the casing.

18. The downhole percussion tool of claim 17, wherein the bit is integrally formed with the mandrel.

19. The downhole percussion tool of claim 17, further comprising a piston slidably mounted within the casing passageway above the mandrel and moveable to deliver an impact force onto the mandrel, the piston comprising:

an interior wall extending from an upper surface of the piston to a lower surface of the piston and defining a piston passageway extending therethrough, the piston passageway receiving a portion of the feed tube, the interior wall of the piston and the outer wall of the feed tube being positioned in close fitting relationship;

an exterior wall surrounding the interior wall and extending from the upper surface of the piston to the lower surface of the piston, the exterior wall and the casing being positioned in close fitting relationship;

a first conduit extending from the interior wall of the piston to the upper surface of the piston, the first conduit being in fluid communication with the at least one opening when the piston is at an up position;

a conduit extending from the interior wall of the piston to the lower surface of the piston, the second conduit being in fluid communication with the at least one opening when the piston is at a down position;

wherein a portion of the casing passageway forms an upper chamber positioned adjacently above the piston and in fluid communication with the first conduit and forms a lower chamber positioned adjacently below the piston and in fluid communication with the second conduit.

20. The downhole percussion tool of claim 19, wherein the at least one opening comprises a plurality of first openings and a plurality of second openings, the plurality of first openings being in fluid communication with the second conduit when the piston is at the down position and the plurality of second openings being in fluid communication with the first conduit when the piston is at the up position.

21. The downhole percussion tool of claim 20, wherein the plurality of first openings are positioned elevationally above the plurality of second openings.

22. The downhole percussion tool of claim 19, wherein the at least one opening comprises a plurality of first openings and a plurality of second openings, the plurality of first openings being in fluid communication with the second conduit when the piston is at one or more first intermediate positions, the one or more first intermediate positions being near the down position and the plurality of second openings being in fluid communication with the first conduit when the piston is at one or more second intermediate positions, the one or more second intermediate positions being near the up position.

23. The downhole percussion tool of claim 19, wherein the piston further comprises at least one exhaust conduit extending from the upper surface of the piston to a lower portion of the interior surface of the piston, the at least one exhaust conduit exhausting fluid from the upper chamber when the piston is at or near the down position.

24. The downhole percussion tool of claim 19, wherein the at least one opening is fluidly coupled with only one of the first conduit or the second conduit.

25. The downhole percussion tool of claim 17, wherein the check valve is positioned downstream of the choke.

26. The downhole percussion tool of claim 25, wherein the choke is replaceable without dismantling the downhole percussion tool.

27. The downhole percussion tool of claim 17, wherein the check valve is positioned upstream of the choke.

28. A method of fabricating a downhole percussion tool, the method comprising:

positioning a piston within a casing and forming an upper chamber adjacently above the piston and a lower chamber adjacently below the piston, the piston comprising an interior wall extending from an upper surface of the piston to a lower surface of the piston and defining a piston passageway extending therethrough;

positioning a feed tube within the casing, the feed tube extending through the piston passageway and positioned in close fitting relationship with the interior wall of the piston, the feed tube comprising:

an upper portion extending from a top end of the feed tube towards a bottom end of the feed tube;

a lower portion extending from a lower end of the upper portion to the bottom end; and an inner wall extending from the top end to the bottom end and defining a central channel therein;

placing a choke at the top end of the feed tube over the central channel, the choke regulating a fluid flow through at least a portion of the central channel; and positioning a check valve in fluid communication with the choke.

29. The method of claim 28, wherein the piston further comprises:

an exterior wall surrounding the interior wall and extending from the upper surface of the piston to the lower surface of the piston, the exterior wall and the casing being positioned in close fitting relationship;

a first conduit extending from the interior wall of the piston to the upper surface of the piston;

a second conduit extending from the interior wall of the piston to the lower surface of the piston; and at least one exhaust conduit extending from the upper surface of the piston to a lower portion of the interior surface of the piston.

30. The method of claim 29, wherein the feed tube further comprises:

an outer wall extending from the top end towards the bottom end and surrounding a portion of the length of the inner wall from the top end, the outer wall and the inner wall defining an outer channel therebetween; and at least one opening formed in the outer wall, wherein the at least one opening is fluidly communicable with the first conduit when the piston is in or near an up position and wherein the at least one opening is fluidly communicable with the second conduit when the piston is in or near a down position, wherein the at least one exhaust conduit exhausts a fluid from the upper chamber when the piston is at or near the down position.

31. The method of claim 30, wherein the interior wall of the piston and the outer wall of the feed tube are in close fitting relationship.

32. The method of claim 30, wherein the at least one opening comprises a plurality of first openings and a plurality of second openings, the plurality of first openings being in fluid communication with the second conduit when the piston is at or near the down position and the plurality of second openings being in fluid communication with the first conduit when the piston is at or near the up position.

33. The method of claim 32, wherein the plurality of first openings are positioned elevationally above the plurality of second openings.

34. The method of claim 32, wherein the plurality of first openings are radially aligned.

35. The method of claim 32, wherein the plurality of second openings are radially aligned.

36. The method of claim 30, wherein the at least one opening is fluidly coupled with only one of the first conduit or the second conduit.

37. The method of claim 28, wherein the check valve is positioned downstream of the choke.

38. The method of claim 28, wherein the check valve is positioned upstream of the choke.

* * * * *